US009858767B2

(12) United States Patent
Billings et al.

(10) Patent No.: US 9,858,767 B2
(45) Date of Patent: Jan. 2, 2018

(54) SYSTEMS AND METHODS FOR OUTPUTTING A REPRESENTATION OF BETTING EVENT INFORMATION FOR A CARD GAME

(71) Applicant: Gamesys Ltd., London (GB)

(72) Inventors: Darse Raymond Billings, London (GB); William Wing Kuei Hong, Woking (GB)

(73) Assignee: Gamesys, Ltd., London (GB)

( * ) Notice: Subject to any disclaimer, the term of this patent is extended or adjusted under 35 U.S.C. 154(b) by 872 days.

(21) Appl. No.: 14/139,868

(22) Filed: Dec. 23, 2013

(65) Prior Publication Data

US 2014/0179406 A1 Jun. 26, 2014

Related U.S. Application Data

(60) Provisional application No. 61/746,115, filed on Dec. 26, 2012.

(51) Int. Cl.
*G07F 17/32* (2006.01)

(52) U.S. Cl.
CPC ..... *G07F 17/3293* (2013.01); *G07F 17/3276* (2013.01)

(58) Field of Classification Search
CPC .. G07F 17/3276; G07F 17/3293; G07F 17/34; G07F 17/326; G07F 17/3272
See application file for complete search history.

(56) References Cited

U.S. PATENT DOCUMENTS 5,299,803 A * 4/1994 Halaby ..... A63F 3/00157 273/148 R
5,961,121 A * 10/1999 Brown ..... A63F 3/00157 273/148 R
8,287,345 B2 * 10/2012 Gross ..... G07F 17/32 463/13
2004/0135316 A1 * 7/2004 Lipscomb ..... G07F 17/32 273/274
2005/0097480 A1 * 5/2005 Care ..... G06F 3/0481 715/859
2006/0058090 A1 * 3/2006 Crawford, III ..... G07F 17/3293 463/13
2007/0015584 A1 * 1/2007 Frenkel ..... G07F 17/32 463/42

(Continued)

*Primary Examiner* — Milap Shah
*Assistant Examiner* — Anh Vo V Nguyen
(74) *Attorney, Agent, or Firm* — Fincham Downs, LLC; Madgalena M. Fincham

(57) ABSTRACT

In accordance with some embodiments, systems, methods and articles of manufacture (e.g., non-transitory computer readable medium) provide for outputting a status (or progress in) betting for a hand (or round of a hand) of an electronic card game. For example, a betting progress indicator may comprise a visual indicator of betting for the hand and may progress from player to player during a hand (or round of a hand) as players Call or Fold but may be reset once a player Raises, thus efficiently indicating to all players that the player who Raised has re-opened betting for the hand (or round of a hand) and that any player after that player who has not previously Folded will need to make another betting decision in the current hand (or round of a hand).

25 Claims, 23 Drawing Sheets

(56) References Cited

U.S. PATENT DOCUMENTS

2007/0045957 A1* 3/2007 Blair, Jr. ..... A63F 3/00157 273/274
2007/0060335 A1* 3/2007 Sakaguchi ..... A63F 13/10 463/30
2007/0063439 A1* 3/2007 Webb ..... A63F 1/00 273/292
2007/0072682 A1* 3/2007 Crawford, III ..... G07F 17/32 463/46
2007/0087832 A1* 4/2007 Abbott ..... G07F 17/32 463/42
2007/0126186 A1* 6/2007 Crawford, III ..... G06Q 10/02 273/459
2007/0136679 A1* 6/2007 Yang ..... H04N 5/44513 715/772
2008/0026826 A1* 1/2008 Groswirt ..... G07F 17/32 463/25
2008/0252011 A1* 10/2008 Bickley ..... G07F 17/32 273/292
2008/0318651 A1* 12/2008 Gross ..... G07F 17/32 463/13
2009/0124316 A1* 5/2009 Baerlocher ..... G07F 17/3227 463/13
2009/0221367 A1* 9/2009 Longley ..... G07F 17/3276 463/32
2010/0105460 A1* 4/2010 Makhoul ..... G07F 17/32 463/13
2010/0259005 A1* 10/2010 Simon ..... A63F 1/00 273/292
2011/0183738 A1* 7/2011 Kirnstotter ..... A63F 1/00 463/13
2011/0195766 A1* 8/2011 Toompere ..... G07F 17/32 463/13
2013/0046641 A1* 2/2013 DeVree ..... G06Q 30/0277 705/14.69
2013/0059644 A1* 3/2013 Ward ..... A63F 1/00 463/22
2013/0059657 A1* 3/2013 Olomskiy ..... A63F 13/77 463/31
2013/0109456 A1* 5/2013 Wilkinson ..... G07F 17/32 463/16
2013/0231168 A1* 9/2013 Rogers ..... H04L 67/34 463/11
2013/0244784 A1* 9/2013 Assa ..... G06F 3/0488 463/40
2014/0045566 A1* 2/2014 Hewins ..... G07F 17/3293 463/13
2014/0128138 A1* 5/2014 Wickett ..... G07F 17/3237 463/13
2014/0148230 A1* 5/2014 Guase ..... G07F 17/3258 463/12

* cited by examiner

SYSTEMS AND METHODS FOR OUTPUTTING A REPRESENTATION OF BETTING EVENT INFORMATION FOR A CARD GAME

CLAIM OF PRIORITY

This application claims the benefit of U.S. Provisional Application No. 61/746,115 filed Dec. 26, 2012 in the name of Billings et al., titled SYSTEMS AND METHODS FOR OUTPUTTING A REPRESENTATION OF BETTING EVENT INFORMATION FOR AN ONLINE CARD GAME. The entirety of this Provisional Application is incorporated by reference herein for all purposes.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

DETAILED DESCRIPTION OF EXAMPLE EMBODIMENTS

Figure 1:
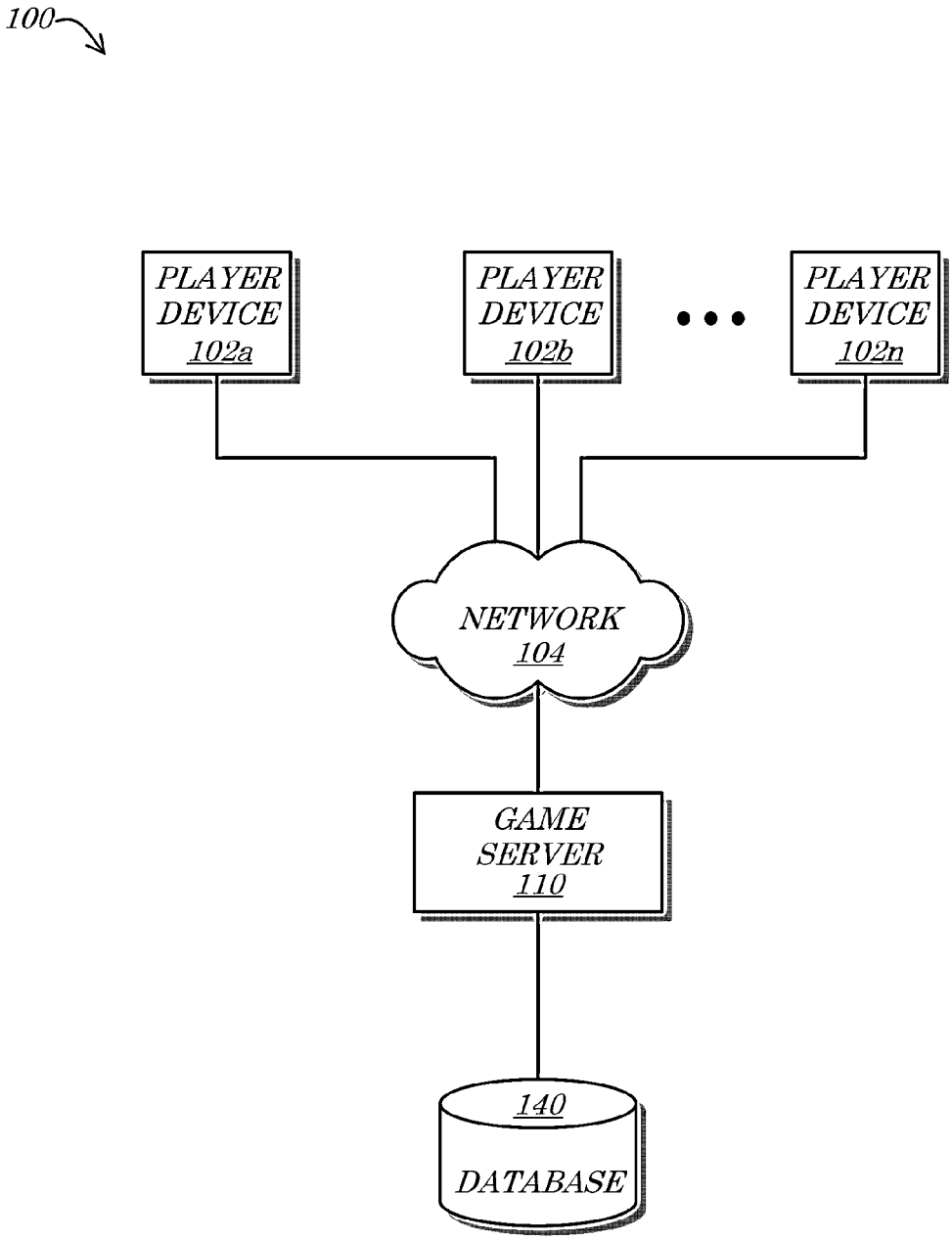
FIG. 1 is a schematic diagram of an embodiment of a gaming system in accordance with one or more embodiments described herein.

Applicants have recognized that some players of online card games may find it confusing or difficult to track betting events that have occurred in a betting round or the current status of a betting round for a given hand of cards. In many card games, there are multiple types of possible events that a given player needs to be aware of in order to effectively and enjoyably participate in the card game and/or in order to maintain a satisfactory tempo or efficient progress during a betting round of the card game. For example, an action by another player in a round of betting may cause a player to have to make additional betting decisions when it is his/her turn to bet. In a specific example, a Raise by a player for a given hand may cause betting to be reopened for a hand or a round of betting for a hand, such that a player who has previously bet a first amount in a current round of a hand may need to consider whether to raise his bet to the new higher bet amount when it is his turn to bet again in the round (and to be aware that there is another decision to be made by him/her in the current betting round, that the betting is coming around to him/her again). For purposes of the present description, the time or segment of a game from when betting is opened until it is closed (whether for a hand or round of a hand) is referred to as a "cycle" of betting. Thus, once betting is re-opened for a hand or round of a hand (e.g., because a player Raises the bet), a new cycle of betting for the hand (or street, in accordance with terminology for some types of card games) is triggered.

Any confusion on the part of the player (or lack of prompt awareness as to the status of a bet) may cause the player (or other players participating in the game) to become frustrated and hold up the progress in the game (or give up playing the game). Consider for example, a game of Texas Hold'Em poker (it should be noted that although an example of Texas Hold'em poker is provided herein for illustrative purposes only, the inventive embodiments described herein have broad applicability to other types of card games such that the illustrated embodiments are not to be taken in a limiting fashion). In a game of Texas Hold'Em, betting for a hand or round of a hand may begin or open once each player participating in the hand provides an 'ante' (an amount which may vary by game and which serves as the player's "buy-in" to qualify for cards dealt for the hand). This may be referred to as an opening of a betting cycle for the current hand in the game. When betting opens for the hand after at least some cards are dealt (the first betting cycle for the hand begins), the first player designated to bet may indicate the amount of his bet, which is added to the "pot." Once another player raises the bet amount, this may be thought of as triggering a re-opening of betting for the hand or round of a hand (the latter term applicable in games involving multiple rounds of betting for a given hand). This event may be referred to herein as triggering a new betting cycle for the hand. In accordance with some embodiments, a hand of a card game may comprise multiple rounds or stages (e.g., a Texas Hold'Em poker game includes three rounds or stages of betting sometimes referred to the Flop, the Turn and the River). Each such round of betting may involve multiple betting cycles (a betting cycle considered to be initiated when a player Raise the current bet amount, thus re-opening betting to allow all other players who have not yet Folded to make another betting decision before betting for the current round is closed). In accordance with some embodiments, it alternatively may be considered that betting for the hand or round of a hand is re-opened once betting returns to the player who placed the first bet. In some variations of poker, the first and/or second player to bet in a given round must bet a predetermined amount or minimum predetermined amount before any cards are dealt, in order to start the pot for the hand (the player positions which are associated with such predetermined opening bets are sometimes referred to as the "Blinds" or "Small Blind" and "Big Blind"); in some games utilizing Blinds the players not in a Blind position may not need to provide an ante in order to receive cards for a hand. Betting typically proceeds around the "table" or virtual table (betting typically proceeds in clockwise order) and each participating player in turn typically has one of three choices when it is his/her turn to bet:

(i) Call: the player can "Call" the last bet, meaning the player bets enough on his turn to match what has been bet since the last time he/she bet or to match the current bet (if the player has not yet bet in the betting cycle). For example, if a first player bet ten (10) credits the last time it was the first player's turn to bet during the current cycle of betting, and a second player has since bet twenty-five (25) credits (thus re-opening betting and triggering a new cycle of betting), the first player would need to add fifteen (15) credits to the pot in order to "Call" the current bet amount. It should be noted that the term "credit" is used in herein for purposes of brevity. Any unit of value may be substituted for the term credit (e.g., U.S. dollar, British pound, Japanese yen, virtual chips, non-monetary credit usable only in other games), irrespective of whether it is redeemable for or has a cash value.

(ii) Raise: the player can "Raise" the last bet or current bet amount, meaning the player may first bet enough to match what has been bet since the last time the player bet (as in calling), then 'raise' the current bet amount by another amount. For example, in No Limit Texas Hold'Em, a player may be limited to raising by any amount from a minimum (e.g., which may equal the size of the initial raise) to a maximum (comprising the total amount of money the player has at the table, or the total that the opponent has, whichever is lower). Continuing the above example, if a first player had previously bet ten (10) credits and a second player has since bet twenty-five (25) credits (raising the bet by fifteen (15) credits and thus re-opening betting), the first player on his/her next turn to bet (e.g., in the next betting cycle for the hand) may choose to raise the bet up to fifty (50) credits (assuming such a Raise would be within any minimum or maximum restrictions on Raises in accordance with the rules of the game). In such a scenario, the first player would need to add fifteen (15) credits to the pot (for Calling the previously raised bet) and another twenty-five (25) credits to raise the bet for the current round to fifty (50) credits, thus the player would need to add forty (40) credits in total to the pot.

(iii) Fold: the player can "Fold" when it is his turn to bet, meaning the player may drop out of the current hand (losing any possibility of winning the pot) and not have to add any additional credits into the pot.

In some embodiments (e.g., if no one has bet so far in the current betting cycle and the value of chips or credits contributed by all active players is equal) a player may have an additional option to "Check" on his turn. If a player chooses to "Check" it typically means the player elects to not bet more at the moment, but remain active and reserve the right to take part in a future betting cycle for the current hand. This may typically occur in a first betting cycle of a given hand, when all players have contributed an equal ante. In some games, such as No Limit Texas Hold'Em, players are not allowed to check in the first betting round because there has already been a Raise in the form of the Blinds (with the exception of the player in the Big Blind position, who may Check if no one raises during the betting cycle).

Of course, it should be understood the above types of betting decisions are exemplary only and other betting decisions and rules may be implemented in a card game and would be within the scope of the embodiments described herein.

In a typical poker game, betting continues (e.g., new betting cycles are initiated when betting is re-opened) until every player either Calls or Folds after a raise or initial bet. At the end of the hand, the highest hand (that hasn't folded) wins the pot.

Thus, as illustrated above, for a given hand in a card game, the betting may go "around the table" several times (e.g., several cycles of betting may occur for a given hand or round of a hand) and the bet amount for the hand may be raised several times during a given hand or round of a hand. The more players participating in a hand, the longer it may take to resolve a winner of the hand and the more betting events any given player who hasn't folded needs to be aware of. Applicants have recognized that there is a need to represent in an improved and uncluttered manner a current status of betting for a hand in order to help online players participate effectively and efficiently in a card game and to help maintain a satisfactory pace for the game. In accordance with one particular embodiment, Applicants have recognized that it would be beneficial to output to a player in an improved and uncluttered manner once a new betting cycle for a current hand has been initiated based on a betting event or decision of a player (whether it be the subject player or another player). In one example illustration, a betting cycle for a hand is represented via a bar or line which progresses from player position to player position along a virtual table representing an online game, which bar or line is re-set and begins anew (or in a visually different form, such that the change is discernable to the players of the game) each time a new betting cycle is triggered by a betting decision of a player or other event in the game.

Accordingly, one or more embodiments comprise systems, method and articles of manufacture (such as non-transitive computer readable media which cause a processor of a computing device to perform said method) which provide for (i) outputting an interface which displays a respective player icon for each player position representing a player of a plurality of players participating in a hand of a card game, the plurality of players including at least a first player, second player and a third player; (ii) determining, by a processor of a computing device operable to facilitate output of information for the card game, a betting decision of the first player; (iii) recognizing that the betting decision corresponds to a start of a betting progress indicator for the round of the card game; (iv) starting a betting progress indicator at a player position of the first player; (v) causing the betting progress indicator to progress to a player position of the second player; (vi) determining a betting decision of the second player; and (vii) determining whether the betting decision of the second player re-opens betting for the round and causing one of the following in response to the betting decision: (a) if the betting decision does not re-open betting for the round, causing the betting progress indicator to advance to a player position of the third player without being reset at the player position of the second player; and (b) if the betting decision does re-open betting for the round, causing the betting progress indicator to be reset at the player position of second player before advancing the betting progress indicator to a player position of the third player.

Certain aspects, advantages, and novel features of the invention are described herein. It is to be understood that not necessarily all such advantages may be achieved in accordance with any particular embodiment of the invention. Thus, for example, those skilled in the art will recognize that the invention may be embodied or carried out in a manner that achieves one advantage or group of advantages as taught herein without necessarily achieving other advantages as may be taught or suggested herein.

Although several embodiments, examples and illustrations are disclosed below, it will be understood by those of ordinary skill in the art that the invention described herein extends beyond the specifically disclosed embodiments, examples and illustrations and includes other uses of the invention and obvious modifications and equivalents thereof. Embodiments of the invention(s) are described with reference to the accompanying figures, wherein like numerals refer to like elements throughout. The terminology used in the description presented herein is not intended to be interpreted in any limited or restrictive manner simply because it is being used in conjunction with a detailed description of certain specific embodiments of the invention (s). In addition, embodiments of the invention(s) can comprise several novel features and it is possible that no single feature is solely responsible for its desirable attributes or is essential to practicing the invention(s) herein described.

Throughout the description that follows and unless otherwise specified, the following terms may include and/or encompass the example meanings provided in this section. These terms and illustrative example meanings are provided to clarify the language selected to describe embodiments both in the specification and in the appended claims, and accordingly, are not intended to be limiting. Other terms are defined throughout the present description.

The terms "information" and "data", as used herein unless specified otherwise, may be used interchangeably and may refer to any data, text, voice, video, image, message, bit, packet, pulse, tone, waveform, and/or other type or configuration of signal and/or information. Information may comprise information packets transmitted, for example, in accordance with the Internet Protocol Version 6 (IPv6) standard as defined by "Internet Protocol Version 6 (IPv6) Specification" RFC 1883, published by the Internet Engineering Task Force (IETF), Network Working Group, S. Deering et al. (December 1995). Information may, according to some embodiments, be compressed, encoded, encrypted, and/or otherwise packaged or manipulated in accordance with any method that is or becomes known or practicable.

The term "indication", as used herein unless specified otherwise, may refer to any indicia and/or other information indicative of or associated with a subject, item, entity, and/or other object and/or idea. As used herein, the phrases "information indicative of" and "indicia" may be used to refer to any information that represents, describes, and/or is otherwise associated with a related entity, subject, or object. Indicia of information may include, for example, a code, a reference, a link, a signal, an identifier, and/or any combination thereof and/or any other informative representation associated with the information. In some embodiments, indicia of information (or indicative of the information) may be or include the information itself and/or any portion or component of the information. In some embodiments, an indication may include a request, a solicitation, a broadcast, and/or any other form of information gathering and/or dissemination.

The term "network component," as used herein unless specified otherwise, may refer to a user or network device, or a component, piece, portion, or combination of user or network devices. Examples of network components may include a Static Random Access Memory (SRAM) device or module, a network processor, and a network communication path, connection, port, or cable.

In addition, some embodiments are associated with a "network" or a "communication network". As used herein, the terms "network" and "communication network" may be used interchangeably and may refer to any object, entity, component, device, and/or any combination thereof that permits, facilitates, and/or otherwise contributes to or is associated with the transmission of messages, packets, signals, and/or other forms of information between and/or within one or more network devices. Networks may be or include a plurality of interconnected network devices. In some embodiments, networks may be hard-wired, wireless, virtual, neural, and/or any other configuration of type that is or becomes known. Communication networks may include, for example, one or more networks configured to operate in accordance with the Fast Ethernet LAN transmission standard 802.3-2002® published by the Institute of Electrical and Electronics Engineers (IEEE). In some embodiments, a network may include one or more wired and/or wireless networks operated in accordance with any communication standard or protocol that is or becomes known or practicable.

The term "player," as used herein unless specified otherwise, may refer to any type, quantity, and or manner of entity associated with the play of a game. In some embodiments, a player may comprise an entity (i) conducting play of an online game, (ii) that desires to play a game (e.g., an entity registered and/or scheduled to play and/or an entity having expressed interest in the play of the game—e.g., a spectator) and/or may (iii) that configures, manages, and/or conducts a game. A player may be currently playing a game or have previously played the game, or may not yet have initiated play—i.e., a "player" may comprise a "potential player" (e.g., in general and/or with respect to a specific game). In some embodiments, a player may comprise a user of an interface (e.g., whether or not such a player participates in a game or seeks to participate in the game). In some embodiments, a player may comprise a virtual player (i.e., a player represented by software controlling betting decisions for a player position).

Some embodiments described herein are associated with a "player device" or a "network device". As used herein, a "player device" is a subset of a "network device". The "network device", for example, may generally refer to any device that can communicate via a network, while the "player device" may comprise a network device that is owned and/or operated by or otherwise associated with a player. Examples of player and/or network devices may include, but are not limited to: a Personal Computer (PC), a computer workstation, a computer server, a printer, a scanner, a facsimile machine, a copier, a Personal Digital Assistant (PDA), a storage device (e.g., a disk drive), a hub, a router, a switch, and a modem, a video game console, or a wireless or cellular telephone. Player and/or network devices may, in some embodiments, comprise one or more network components.

Turning now to FIG. 1, illustrated therein is a block diagram of an example system 100 consistent with at least some embodiments. The system 100 may comprise a plurality of player devices 102*a*-102*n* in communication with a game server 110 via a network 104. For purposes of brevity, any or all of the player devices 102*a*-102*n* will be referred to as a player device 102 herein, even though the plurality of player devices 102*a*-102*n* may include different types of player devices (as described below). The game server 110 may also be operable to communicate with or access a database 140 (which may comprise one or more databases and/or tables and which may comprise a storage device distinct from (or be a component of) the game server 110). It should be noted that in some embodiments database 140 may be stored on a game server 110 while in other embodiments database 140 may be stored on another computing device with which game server 110 is operable to communicate in order to at least access the data in database 140 (e.g., another server device remote from game server 140, operable to determine outcomes for an event instance of a game). In some embodiments a processor (e.g., one or more microprocessors, one or more microcontrollers, one or more digital signal processors) of a player device 102 and/or game server 110 may receive instructions (e.g., from a memory or like device), and execute those instructions, thereby performing one or more processes defined by those instructions. Instructions may be embodied in, e.g., one or more computer programs and/or one or more scripts.

In some embodiments a game server 110 and/or one or more of the player devices 102 stores and/or has access to data useful for facilitating play of a game (e.g., a card game). For example, game server 110 and/or a player device 102 may store (i) one or more probability databases for determining one or more outcome(s) (e.g., cards to be dealt to one or more players of a card game) for an event instance (e.g., hand or round) of a game, (ii) a current state or status of a game or game session (e.g., what cards are held by each of the participating players, the current bet amount for each player, a most recent bet decision of each participating player, etc.), (iii) one or more user interfaces for use in a game, (iv) one or more game themes for a game and/or (v) profiles or other personal information associated with a player of a game (e.g., betting trends or betting profile of a player). It should be noted that in some embodiments such data may be stored on the game server 110 and information based on such data may be output to a player device 102 during play of a game while in other embodiments a game program may be downloaded to a local memory of a player device 102 and thus such data may be stored on a player device 102 (e.g., in encrypted or other secure or tamper-resistant form).

A game server 110 may comprise a computing device for facilitating play of a game (e.g., by receiving an input from a player (e.g., bet decision), determining an outcome or data for a game (e.g., cards dealt and/or winner of the hand), causing data of a game (e.g., cards dealt) to be displayed on a player device, facilitating a wager and/or a provision of a payout for a game). For example, the game server 110 may comprise a server computer operated by a game provider or another entity (e.g., a social network website not primarily directed at providing games). In some embodiments, the game server may determine data (e.g., cards to be dealt to one or more players) for a game by requesting and receiving such data from another remote server operable to provide such data. In some embodiments, the game server 110 may further be operable to facilitate a game program for a game (e.g., a wagering game). In accordance with some embodiments, in addition to administering or facilitating play of a game, a game server 110 may comprise one or more computing devices responsible for handling online processes such as, but not limited to: serving a website comprising one or more games to a player device and/or processing transactions (e.g., wagers, deposits into financial accounts, managing accounts, controlling games, etc). In some embodiments, game server 110 may comprise two or more server computers operated by the same entity (e.g., one server being primarily for storing states of games in progress and another server being primarily for storing mechanisms for determining outcomes of games, such as a random number generator). Examples of processes that may be performed by the game server 110 (directly or indirectly) may include, but are not limited to: (i) determining a bet decision of a player; (ii) determining whether to progress or reset a betting progress indicator or other indicator of a progression of game events (which may, in some embodiments, comprise determining whether a new betting cycle has been triggered for the hand), based on a bet decision of a player; (iii) transmitting an indication of game elements determined for the game (e.g., cards to be dealt to players participating in the game); (iv) determining one or more winners of a hand of the game and/or the amounts won or lost by players participating in the hand based on cards dealt to the players and bets made by the players; (v) authorizing a game program to be downloaded to a player device; and/or (vi) authorizing an amount of value to be added to or removed from an account of a player (e.g., based on a result of a hand of the game).

Turning now to a description of a player device 102, in accordance with some embodiments a player device 102 may comprise a computing device that is operable to execute or facilitate the execution of a game program and used or useful by an online player for accessing an online casino or other electronic (e.g., online) game provider. For example, a player device 102 may comprise a desktop computer, computer workstation, laptop, mobile device, tablet computer, Personal Digital Assistant (PDA) devices, cellular or other wireless telephones (e.g., the Apple™ iPhone™), video game consoles (e.g., Microsoft™ Xbox 360™, Sony™ Playstation™, and/or Nintendo™ Wii™), and/or handheld or portable video game devices (e.g., Nintendo™ Game Boy™ or Nintendo™ DS™). A player device 102 may comprise and/or interface with various components such as input and output devices (each of which is described in detail elsewhere herein) and, in some embodiments, game server 110. A player device 102 may be a dedicated gaming device (e.g., a slot machine or video poker type of machine) or a non-dedicated gaming device (e.g., a smart phone, tablet, laptop or desktop computer). It should be noted that a game server 110 may be in communication with a variety of different types of player devices 102.

A player device 102 may be used to play a wagering or non-wagering game (e.g., a social or casual game) over a network and output information relating to the game to players participating in the game (e.g., cards dealt for a hand of the game, updating a betting progress indicator based on one or more bet decisions of players, credit balance of credits available for play of the game, etc.). Any and all information relevant to any of the aforementioned functions may be stored locally on one or more of the player devices 102 and/or may be accessed using one or more of the player devices 102 (in one embodiments such information being stored on, or provided via, the game server 110). In another embodiment, a player device 102 may store some or all of the program instructions for determining, for example, (i) that an event instance has been triggered or initiated (and, in some embodiments, communicating such a trigger or initiation to game server 110), such as determining that the dealing of a new hand has been requested by the players; (ii) outputting the one or more cards for the hand to the players, (iii) receiving bet decisions from players and outputting an indication of such bet decisions to the other players; (iii) determining whether to reset or progress a bet progress indicator based on such bet decisions (which may, in some embodiments, comprise determining whether a new betting cycle has been triggered for the hand); and/or (iv) determining a winner of a hand. In some embodiments, the game server 110 may be operable to authorize the one or more player devices 102 to access such information and/or program instructions remotely via the network 104 and/or download from the game server 110 (e.g., directly or via an intermediary server such as a web server) some or all of the program code for executing one or more of the various functions described in this disclosure. In other embodiments, outcome and result determinations may be carried out by the game server 110 (or another server with which the game server 110 communicates) and the player devices 102 may be terminals for displaying to an associated player such outcomes and results and other graphics and data related to a game.

It should be noted that the one or more player devices 102 may each be located at the same location as at least one other player device 102 (e.g., such as in a casino or internet café) or remote from all other player devices 102. Similarly, any given player device may be located at the same location as the game server 110 or may be remote from the game server 110. It should further be noted that while the game server 110 may be useful or used by any of the player devices 102 to perform certain functions described herein, the game server 110 need not control any of the player devices 102. For example, in one embodiment the game server 110 may comprise a server hosting a website of an online casino accessed by one or more of the player devices 102.

In one embodiment, a game server 110 may not be necessary or desirable. For example, some embodiments described in this disclosure may be practiced on one or more player devices 102 without a central authority. In such an embodiment, any functions described herein as performed by a game server 110 and/or data described as stored on a game server 110 may instead be performed by or stored on one or more player devices 102. Additional ways of distributing information and program instructions among one or more player devices 102, a game server 110 and/or another server device will be readily understood by one skilled in the art upon contemplation of the present disclosure.

Figure 2:
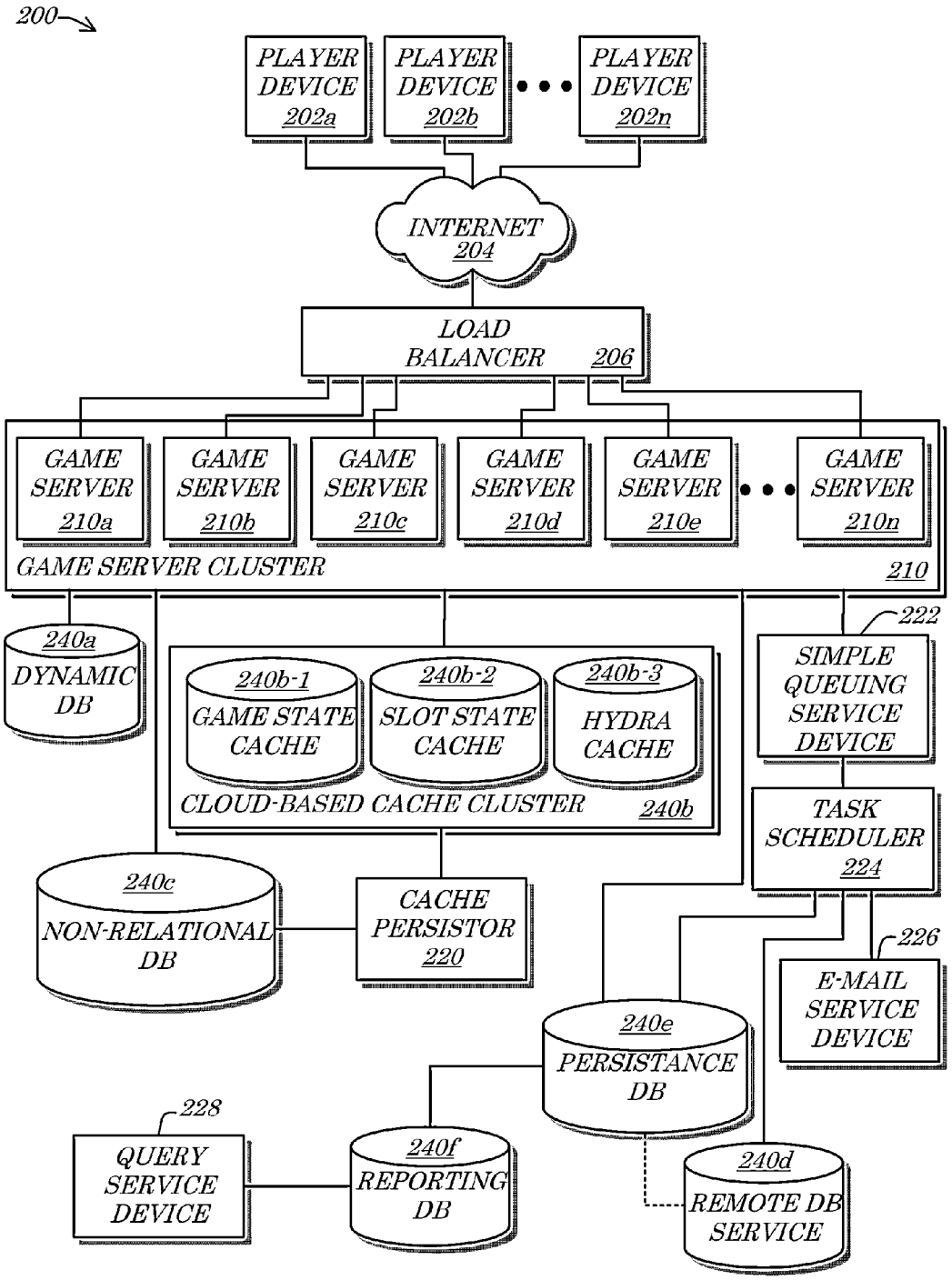
FIG. 2 is a schematic diagram of an embodiment of a social gaming platform in accordance with one or more embodiments described herein.

Referring now to FIG. 2, illustrated therein is a block diagram of a system 200 according to some embodiments. In some embodiments, the system 200 may comprise a plurality of player devices 202*a-n*, the Internet 204, a load balancer 206, and/or a game server cluster 210. The game server cluster 210 may, in some embodiments, comprise a plurality of game servers 210*a-n*. In some embodiments, the system 200 may comprise a cache persistor 220, a Simple Queuing Service (SQS) device 222, a task scheduler 224, an e-mail service device 226, and/or a query service device 228. As depicted in FIG. 2, any or all of the various components 202*a-n*, 204, 206, 210*a-n*, 220, 222, 224, 226, 228 may be in communication with and/or coupled to one or more databases 240*a-f*. The system 200 may comprise, for example, a dynamic DataBase (DB) 240*a*, a cloud-based cache cluster 240*b* (e.g., comprising a game state cache 240*b*-1, a slot state cache 240*b*-2, and/or a "hydra" cache 240*b*-3), a non-relational DB 240*c*, a remote DB service 240*d*, a persistence DB 240*e*, and/or a reporting DB 240*f*.

According to some embodiments, any or all of the components 202*a-n*, 204, 206, 210*a-n*, 220, 222, 224, 226, 228, 240*a-f* of the system 200 may be similar in configuration and/or functionality to any similarly named and/or numbered components described herein. Fewer or more components 202*a-n*, 204, 206, 210*a-n*, 220, 222, 224, 226, 228, 240*a-f* (and/or portions thereof) and/or various configurations of the components 202*a-n*, 204, 206, 210*a-n*, 220, 222, 224, 226, 228, 240*a-f* may be included in the system 200 without deviating from the scope of embodiments described herein. While multiple instances of some components 202*a-n*, 210*a-n*, 240*a-f* are depicted and while single instances of other components 204, 206, 220, 222, 224, 226, 228 are depicted, for example, any component 202*a-n*, 204, 206, 210*a-n*, 220, 222, 224, 226, 228, 240*a-f* depicted in the system 200 may comprise a single device, a combination of devices and/or components 202*a-n*, 204, 206, 210*a-n*, 220, 222, 224, 226, 228, 240*a-f*, and/or a plurality of devices, as is or becomes desirable and/or practicable. Similarly, in some embodiments, one or more of the various components 202*a-n*, 204, 206, 210*a-n*, 220, 222, 224, 226, 228, 240*a-f* may not be needed and/or desired in the system 200.

According to some embodiments, the player device 202*a-n* may be utilized to access (e.g., via the Internet 204 and/or one or more other networks not explicitly shown) content provided by the game server cluster 210. The game server cluster 210 may, for example, provide, manage, host, and/or conduct various online and/or otherwise electronic games such as online bingo, slots, poker, and/or other games of chance, skill, and/or combinations thereof (e.g., a Texas Hold'Em poker game). In some embodiments, the various game servers 210*a-n* (virtual and/or physical) of the game server cluster 210 may be configured to provide, manage, host, and/or conduct individual instances of available game types. A first game server 210*a*, for example, may host a first particular instance of an online poker game (or tournament), a second game server 210*c* may host a second particular instance of an online poker game (or tournament), a third game server 210*c* may facilitate an online poker tournament, and/or a fourth game server 210*d* may provide an online slots game.

In some embodiments, the player devices 202*a-n* may comprise various components (hardware, firmware, and/or software; not explicitly shown) that facilitate game play and/or interaction with the game server cluster 210. The player device 202*a-n* may, for example, comprise a gaming client such as a software application programmed in Adobe® Flash® and/or HTML 5 that is configured to send requests to, and receive responses from, one or more of the game servers 210*a-n* of the game server cluster 210. In some embodiments, such an application operating on and/or via the player devices 202*a-n* may be configured in Model-View-Controller (MVC) architecture with a communication manager layer responsible for managing the requests to/responses from the game server cluster 210. In some embodiments, one or more of the game servers 210*a-n* may also or alternatively be configured in a MVC architecture with a communication manager and/or communications management layer. In some embodiments, communications between the player devices 202*a-n* and the game server cluster 210 may be conducted in accordance with the HyperText Transfer Protocol (HTTP) version 1.1 (HTTP/1.1) as published by the Internet Engineering Taskforce (IET) and the World Wide Web Consortium (W3C) in RFC 2616 (June 1999).

According to some embodiments, communications between the player devices 202*a-n* and the game server cluster 210 may be managed and/or facilitated by the load balancer 206. The load balancer 206 may, for example, route communications from player devices 202*a-n* to one or more of the specific game servers 210*a-n* depending upon various attributes and/or variables such as bandwidth availability (e.g., traffic management/volumetric load balancing), server load (e.g., processing load balancing), server functionality (e.g., contextual awareness/availability), and/or player-server history (e.g., session awareness/stickiness). In some embodiments, the load balancer 206 may comprise one or more devices and/or services provided by a third-party (not shown). The load balancer 206 may, for example, comprise an Elastic Load Balancer (ELB) service provided by Amazon® Web Services, LLC of Seattle, Wash. According to some embodiments, such as in the case that the load balancer 206 comprises the ELB or a similar service, the load balancer 206 may manage, set, determine, define, and/or otherwise influence the number of game servers 210*a-n* within the game server cluster 210. In the case that traffic and/or requests from the player devices 202*a-n* only require the first and second game servers 210*a-b*, for example, all other game servers 210*c-n* may be taken off-line, may not be initiated and/or called, and/or may otherwise not be required and/or utilized in the system 200. As demand increases (and/or if performance, security, and/or other issues cause one or more of the first and second game servers 210*a-b* to experience detrimental issues), the load balancer 206 may call and/or bring online one or more of the other game servers 210*c-n* depicted in FIG. 2. In the case that each game server 210*a-n* comprises an instance of an Amazon® Elastic Compute Cloud (EC2) service, the load balancer 206 may add or remove instances as is or becomes practicable and/or desirable.

In some embodiments, the load balancer 206 and/or the Internet 204 may comprise one or more proxy servers and/or devices (not shown in FIG. 2) via which communications between the player devices 202*a-n* and the game server cluster 210 are conducted and/or routed. Such proxy servers and/or devices may comprise one or more regional game hosting centers, for example, which may be geographically dispersed and addressable by player devices 202*a-n* in a given geographic proximity. In some embodiments, the proxy servers and/or devices may be located in one or more geographic areas and/or jurisdictions while the game server cluster 210 (and/or certain game servers 210*a-n* and/or groups of game servers 210*a-n* thereof) is located in a separate and/or remote geographic area and/or jurisdiction.

According to some embodiments, for specific game types, if any, the game server cluster 210 may provide game outcomes to a controller device (not separately shown in FIG. 2) that times the release of game outcome information to the player devices 202*a-n* such as by utilizing a broadcaster device (also not separately shown in FIG. 2) that transmits the time-released game outcomes to the player devices 202*a-n* (e.g., in accordance with the Transmission Control Protocol (TCP) and Internet Protocol (IP) suite of communications protocols (TCP/IP), version 4, as defined by "Transmission Control Protocol" RFC 793 and/or "Internet Protocol" RFC 791, Defense Advance Research Projects Agency (DARPA), published by the Information Sciences Institute, University of Southern California, J. Postel, ed. (September 1981)).

In some embodiments, the game server cluster 210 (and/or one or more of the game servers 210*a-n* thereof) may be in communication with the dynamic DB 240*a*. According to some embodiments, the dynamic DB 240*a* may comprise a dynamically-scalable database service such as the DyanmoDB™ service provided by Amazon® Web Services, LLC. The dynamic DB 240*a* may, for example, store information specific to one or more certain game types (e.g., a multi-player poker game) provided by the game server cluster 210 such as to allow, permit, and/or facilitate reporting and/or analysis of such information.

According to some embodiments, the game server cluster 210 (and/or one or more of the game servers 210*a-n* thereof) may be in communication with the cloud-based cache cluster 240*b*. Game state information from the game server cluster 210 may be stored in the game state cache 240*b*-1, for example, card game state (e.g., card-game specific state) data may be stored in the game state cache 240*b*-2, and/or other game and/or player information (e.g., progressive data, player rankings, audit data) may be stored in the hydra cache 240*b*-3. In some embodiments, the cache persistor 220 may move and/or copy data stored in the cloud-based cache cluster 240*b* to the non-relational DB 240*c*. The non-relational DB 240*c* may, for example, comprise a SimpleDB™ service provided by Amazon® Wed Services, LLC. According to some embodiments, the game server cluster 210 may generally access the cloud-based cache cluster 240*b* as-needed to store and/or retrieve game-related information. The data stored in the cloud-based cache cluster 240*b* may generally comprise a subset of the newest or freshest data, while the cache persistor 220 may archive and/or store or move such data to the non-relational DB 240*c* as it ages and/or becomes less relevant (e.g., once a player logs-off, once a game session and/or tournament ends). The game server cluster 210 may, in accordance with some embodiments, have access to the non-relational DB 240*c* as-needed and/or desired. The game servers 210*a-n* may, for example, be initialized with data from the non-relational DB 240*c* and/or may store and/or retrieve low frequency and/or low priority data via the non-relational DB 240*c*.

In some embodiments, the SQS device 222 may queue and/or otherwise manage requests, messages, events, and/or other tasks or calls to and/or from the server cluster 210. The SQS device 222 may, for example, prioritize and/or route requests between the game server cluster 210 and the task scheduler 224. In some embodiments, the SQS device 222 may provide mini-game and/or tournament information to the server cluster 210. According to some embodiments, the task scheduler 224 may initiate communications with the SQS device 222, the e-mail service provider 226 (e.g., providing e-mail lists), the remote DB service 240*d* (e.g., providing inserts and/or updates), and/or the persistence DB 240*e* (e.g., providing and/or updating game, player, and/or other reporting data), e.g., in accordance with one or more schedules.

According to some embodiments, the persistence DB 240*e* may comprise a data store of live environment game and/or player data. The game server cluster 210 and/or the task scheduler 224 or SQS device 222 may, for example, store game and/or player data to the persistence DB 240*e* and/or may pull and/or retrieve data from the persistence DB 240*e*, as-needed and/or desired. The server cluster 210 may, according to some embodiments, provide and/or retrieve bet cycle and/or other game event information and/or configuration information via the persistence DB 240*e*.

In some embodiments, the reporting DB 240*f* may be created and/or populated based on the persistence DB 240*e*. On a scheduled and/or other basis, for example, a data transformation and/or mapping program may be utilized to pull data from the live environment (e.g., the persistence DB 240*e*) into the reporting DB 240*f*. The query service 228 may then be utilized, for example, to query the reporting DB 240*f*, without taxing the live environment and/or production system directly accessible by the game server cluster 210.

Figure 3:
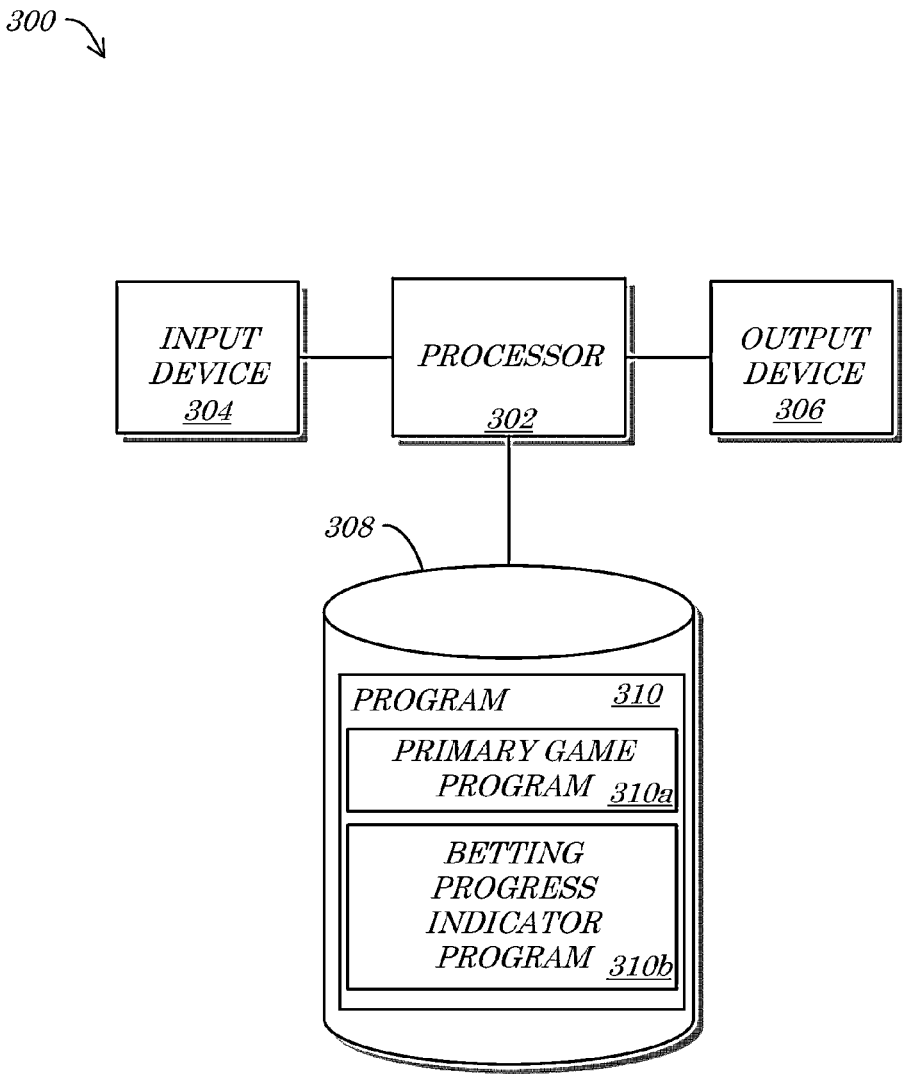
FIG. 3 is a block diagram of an embodiment of a computing device useful in a system according to one or more embodiments described herein.

Referring now to FIG. 3 is a block diagram of an apparatus 300 according to some embodiments. In some embodiments, the apparatus 300 may be similar in configuration and/or functionality to any of the player devices 102, the game server 110 and/or another server device operable to facilitate the embodiments described herein. The apparatus 300 may, for example, execute, process, facilitate, and/or otherwise be associated with any of the process 1000 described herein with reference to FIG. 10.

In some embodiments, the apparatus 300 may comprise a processor 302, an input device 304, an output device 306 and/or a memory device 308. Fewer or more components and/or various configurations of the components 302, 304, 306 and/or 308 may be included in the apparatus 300 without deviating from the scope of embodiments described herein.

According to some embodiments, the processor 302 may be or include any type, quantity, and/or configuration of processor that is or becomes known. The processor 302 may comprise, for example, an Intel® IXP 2800 network processor or an Intel® XEON™ Processor coupled with an Intel® E7501 chipset. In some embodiments, the processor 302 may comprise multiple interconnected processors, microprocessors, and/or micro-engines. According to some embodiments, the processor 302 (and/or the apparatus 300 and/or other components thereof) may be supplied power via a power supply (not shown) such as a battery, an Alternating Current (AC) source, a Direct Current (DC) source, an AC/DC adapter, solar cells, and/or an inertial generator. In the case that the apparatus 302 comprises a server such as a blade server, necessary power may be supplied via a standard AC outlet, power strip, surge protector, and/or Uninterruptible Power Supply (UPS) device.

In some embodiments, the input device 304 and/or the output device 306 are communicatively coupled to the processor 302 (e.g., via wired and/or wireless connections and/or pathways) and they may generally comprise any types or configurations of input and output components and/or devices that are or become known, respectively.

The input device 304 may comprise, for example, a keyboard that allows an operator of the apparatus 300 to interface with the apparatus 200 (e.g., by a player, an employee or other worker affiliated with either an online casino or other entity operating a system which provides games to players). In some embodiments, the input device 304 may comprise a mechanism configured to indicate to a remote server device an initiation of an event and/or a bet decision of a player during a game (e.g., that a player has joined a game, requested that cards be dealt for a hand of a card game or indicated that he/she would like to Raise a current bet amount during a bet cycle), such information being provided to the apparatus 300 and/or the processor 302. In such embodiments, the input device may comprise a key on a keyboard of the apparatus 300. Other examples of input devices include, but are not limited to: a game controller and/or gamepad, a bar-code scanner, a magnetic stripe reader, a pointing device (e.g., a computer mouse, touchpad, and/or trackball), a point-of-sale terminal keypad, a touch-screen, a microphone, an infrared sensor, a sonic ranger, a computer port, a video camera, a motion detector, a digital camera, a network card, a Universal Serial Bus (USB) port, a GPS receiver, a Radio Frequency Identification (RFID) receiver, a RF receiver, a thermometer, a pressure sensor, and a weight scale or mass balance.

The output device 306 may, according to some embodiments, comprise a display screen and/or other practicable output component and/or device that is operable to output information. The output device 306 may, for example, comprise a display screen via which are output instructions, guidance, questions or information to a player of an online game. For example, the output device may output a game interface for outputting information regarding a current ongoing hand of a card game, such as the status of players participating in the hand, their current bet amounts and a status of a betting progress indicator, to help a given player quickly and visually understand whether a new bet cycle has been initiated based on a bet decision of another player. Some additional examples of output devices that may be useful in some embodiments include a Cathode Ray Tube (CRT) monitor, a Liquid Crystal Display (LCD) screen, a Light Emitting Diode (LED) screen, a printer, an audio speaker, an Infra-red Radiation (IR) transmitter, an RF transmitter, and/or a data port. According to some embodiments, the input device 304 and/or the output device 306 may comprise and/or be embodied in a single device such as a touch-screen monitor.

In some embodiments, the apparatus 300 may comprise any type or configuration of communication device (not shown) that is or becomes known or practicable. For example, the apparatus 300 may include a communication device such as a NIC, a telephonic device, a cellular network device, a router, a hub, a modem, and/or a communications port or cable. In some embodiments, the communication device may be coupled to provide data to a telecommunications device. The communication device may, for example, comprise a cellular telephone network transmission device that sends signals (e.g., a bet decision of a player participating in a multi-player online card game) to a server (e.g., game server 110) in communication with a plurality of player devices 102. According to some embodiments, the communication device may also or alternatively be coupled to the processor 302. In some embodiments, the communication device may comprise an IR, RF, Bluetooth™, and/or Wi-Fi® network device coupled to facilitate communications between the processor 202 and another device.

The memory device 308 may comprise any appropriate information storage device that is or becomes known or available, including, but not limited to, units and/or combinations of magnetic storage devices (e.g., a hard disk drive), optical storage devices, and/or semiconductor memory devices such as Random Access Memory (RAM) devices, Read Only Memory (ROM) devices, Single Data Rate Random Access Memory (SDR-RAM), Double Data Rate Random Access Memory (DDR-RAM), and/or Programmable Read Only Memory (PROM).

The memory device 308 may, according to some embodiments, store a program 310 for facilitating one or more of the embodiments described herein, which program may include a primary game program 310*a* for facilitating play of a multi-player online card game and a betting progress indicator program 310*b* for facilitating an updating of a status of a betting progress indicator (e.g., resetting or restating the betting progress indicator) based on one or more bet decisions of one or more players participating in the card game. In some embodiments, the primary game program 310*a* and/or the betting progress indicator program 310*b* may be utilized by the processor 302 to provide output information via the output device 306.

The primary game program 310*a* may, for example, comprise instructions for (i) determining cards to be dealt to players participating in an online poker game or other card game, (ii) recognizing a bet decision of a player and outputting it to the other players of the game; and/or (iii) determining a winner of a hand of the online poker game or other card game. The betting progress indicator program 310 *b* may, for example, comprise instructions for (i) accessing one or more predetermined events which, if they occur during a betting cycle of a game, cause a resetting (or other predetermined adjustment) in the betting progress indicator; (ii) monitoring events in the game to determine whether they match any of the one or more predetermined events; and (iii) resetting the betting progress indicator (or otherwise adjusting the betting progress indicator, based on the implemented embodiment) once it is determined that an event in the game matches a predetermined event. In some embodiments, the betting progress indicator program 310*b* may store, for a given hand or round of a game, a history of events which occurred in the hand or round of the game. In such embodiments, an adjustment of a betting progress indicator may be based on previous events in the hand or round of the game (e.g., how many previous betting cycles have been triggered during the hand or round of the game) and such data may be accessed by the program to determine the appropriate status or adjustment for the betting progress indicator in response to a current event in the game.

Turning now to FIGS. 4A through 4F, illustrated therein is one example embodiment of a game interface (e.g., a screen shot of an online game) for facilitating an online card game, as it is adjusted or modified based on events which are detected during play of the game. In particular, FIGS. 4A through 4F illustrate how a betting progress indicator may be progressed and reset based on bet decisions of players over the course of a hand of the card game, in a manner consistent with one or more embodiments described herein. Examples of one or more game events (e.g., betting decision events) which may cause a betting progress indicator to be progressed, adjusted, modified or reset include, without limitation: (i) a change in whose turn it is to bet; (ii) a player raising the bet amount for the current betting round; (iii) a change in the direction in which betting is moving around a virtual table of players; (iv) a re-opening of a betting cycle for a hand or round based on a bet decision of a player, such that other players will need to make additional betting decisions; and (v) a change in a current value of a bet or a hand.

It should be noted that the example embodiments of interface mechanisms, designs and structures illustrated in the FIGS. 4A through 4F (as well as in FIGS. 5A through 5B, FIG. 6, FIGS. 7A through 7F, and FIGS. 8A through 8D) may be interfaces output via a display of a player device (e.g., via a web browser or graphical user interface client program displaying information of a live online card game). Indications of betting information or data for a current betting cycle, round or hand may be output via such interfaces to players participating in the the game, in a manner which helps the players more easily and efficiently understand the status and/or progress of betting and/or whether a given player will need to make any additional betting decisions for a betting round or other phase or aspect of a hand (e.g., based on whether another player's activity reopened betting for the current betting round, thus initiating a new betting cycle for the current betting round). One or more players may be participating in an online or otherwise virtual card game by use of player devices operable to communicate with one another via network. The card games may be conducted, for example, via a system structure such as that illustrated in and described with respect to FIGS. 1 and 2. Of course, the interfaces illustrated in any or all of FIGS. 4A through 4F, FIGS. 5A through 5B, FIG. 6, FIGS. 7A through 7F and FIGS. 8A through 8D may also be useful in other electronic versions of card or other types of games (e.g., games played locally on a player's device, in an intranet devices with multiple players playing on devices operable to communicate with one another, etc.).

FIGS. 4A through 4F illustrate an embodiment in which a line or bar (betting progress indicator 410) indicates the progression of betting in a given betting cycle, wherein the bar "resets" or starts anew upon an occurrence of a predetermined event within the game and thus indicates an initiation of a new betting cycle in a current betting round or hand. In particular, in the embodiment illustrated in FIGS. 4A through 4F, the betting progress indicator 410 proceeds from player to player but resets (i.e., is restarted) upon an occurrence of certain betting decisions of players participating in the game (e.g., bar may reset once a player Raises, indicating betting for the hand or round within the hand has been re-opened). FIGS. 4A through 4F illustrate a non-limiting and exemplary interface 400 (illustrated via progressing screen shots 400A through 400F) from the perspective of how a subject player (player 401, labeled as "Me" in the figures) is presented information with respect to betting in a current betting cycle, round or hand, as it pertains to the other players participating in the game (in the present example, this being player 403 (labeled as "John T"), player 405 (labeled as "Robert G."), player 407 (labeled as "Tim W."), player 409 (labeled as "John S.") and player 411 (labeled as "Jessica")). For example, the screen shot 400A includes information indicating the current bet amount for each player (in areas along the betting progress indicator 410, in particular in area 407*a* for player 407, area 409*a* for player 409 and area 411*a* for player 411, which are the only players who have placed a bet in the current betting cycle thus far).

Also shown in the screen shot 400A is the status of betting for the current betting cycle, via the betting progress indicator 410. In particular, the betting progress indicator 410 indicates who has initiated (or is the last player to have raised the bet amount, thus re-opening betting) in the current betting cycle (as indicated by which player the betting progress indicator 410 begins with) and who the betting decision is currently with (as indicated by where the betting progress indicator 410 ends). Finally, screen shot 400A 400 shows an input mechanism or area 420 (e.g., an area of a touch screen or an area which is otherwise selectable by a player via a player device) via which the player may indicate a betting decision for the current bet cycle. In accordance with some embodiments, the area 420 may only become active or selectable by the player when it is the player's turn to make a betting decision (or shortly beforehand). In some embodiments, the betting choices (including amounts) output in area 420 may be dynamically adjusted during the betting cycle based on betting decisions of other players. For example, if another player raises a bet from X to Y, the "Call" amount for the player may be updated in the appropriate section of area 420 from X to Y to reflect the amount the player would have to bet in order to Call the current bet for the betting cycle.

In the present application, like reference numerals in the Figures refer to like elements. Thus, for example, in the FIGS. 4A through 4F (which show a progression of betting over the course of a round in a hand of a Texas Hold'Em game), area 420 is repeated (although it may be shown to output different values, depending on the status of betting in the round and options available to player 401).

It should be noted that additional information may be output to the player via the interface illustrated in FIGS. 4A through 4F, which additional information is omitted herein for purposes of brevity. For example, available funds or credits for betting, session information, player history or preferences, community cards available to all players participating in the game, information about other games the player is participating in, recommendations or tips for betting, etc. may be show for one or more players. It should further be noted that although the particular embodiment of FIGS. 4A through 4F illustrates the player positions as placed along an oval pattern (e.g., as if they were sitting around an oval shaped card table), any shape or arrangement of player positions may be utilized. Further, the space between player 401 and player 403, as well as the space between player 403 and player 405, may comprise a representation of spaces available for additional players to join the game or spaces representing players who are sitting out the current hand.

Figure 4A:
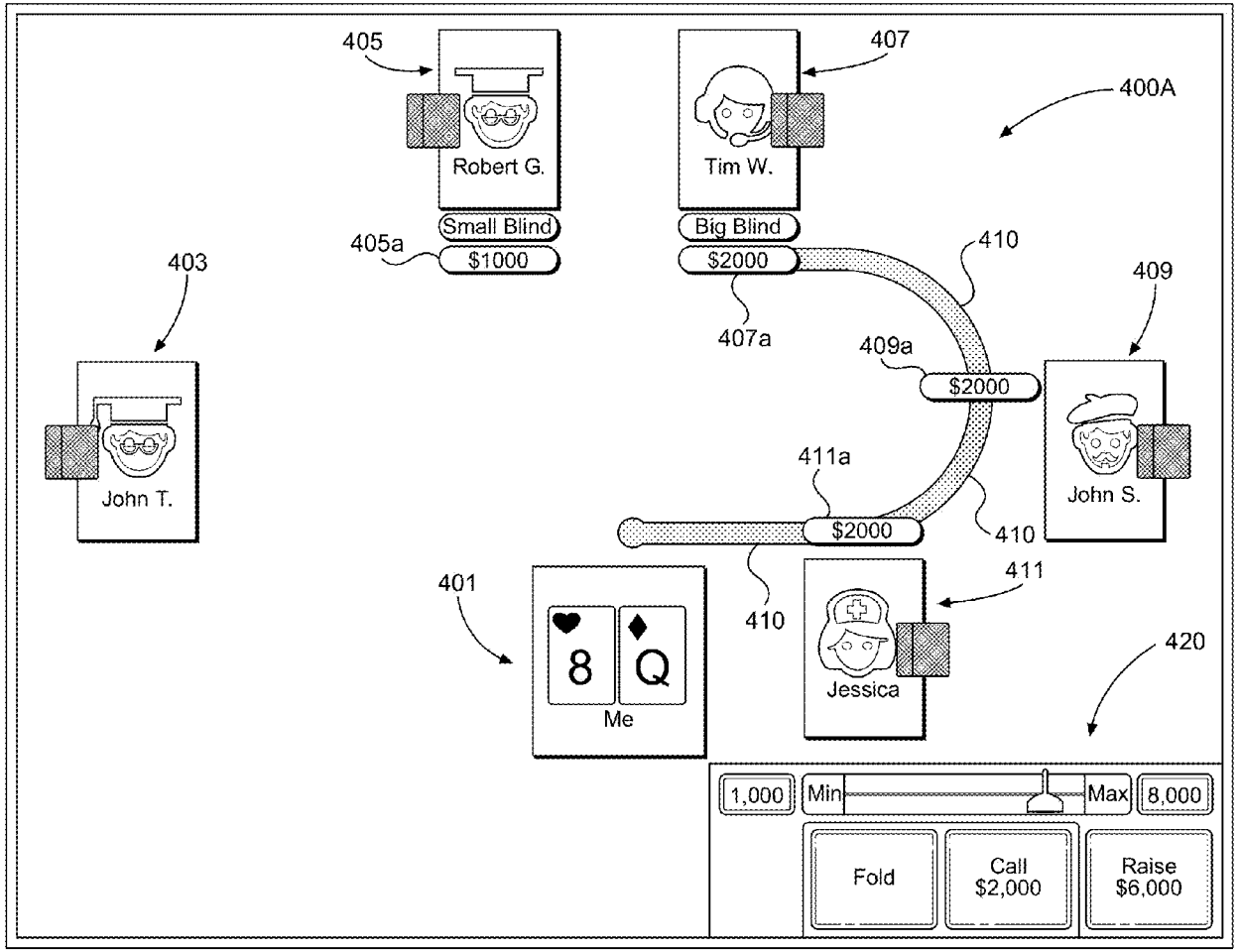
FIGS. 4A through 4F together illustrate one example embodiment of a game interface (e.g., a screen shot of an online game) for facilitating an online card game, as it is modified based on bet decisions of players over the course of a hand of the card game, in a manner consistent with one or more embodiments described herein.

FIG. 4A is an illustration of a screen shot which shows a "snapshot in time" of a current status of betting in a current betting round or hand and how a current betting cycle for the round or hand has developed thus far, as it may be shown on a display of a player device. In particular, FIG. 4A illustrates that player 405 (at the position labeled "Small Blind") has bet $1000, player 407 (at the position labeled "Big Blind") has bet $2000, that players 409 and 411 have, respectively, each also bet $2000 (i.e., neither player 409 nor player 411 has Raised the bet amount for the current betting cycle) and that the betting decision now rests with player 401. In accordance with one embodiment, FIG. 4A illustrates that the betting progress indicator 410 begins at the position of player 407, because that is the player with whom the current bet of $2000 originated. Although player 405 (positioned at the Small Blind) also placed a bet for the current betting cycle ($1000, as show in area 405*a*), the bet amount for the current betting cycle has since been raised to $2000. Thus, player 405 will have another chance to make a betting decision in the current betting cycle (whether the bet amount is further raised by either of players 401 or 403 or stays at $2000) and the visual aid of the betting progress indicator efficiently and clearly shows this because, in accordance with at least some embodiments, the betting progress indicator 410 progresses until the end of it meets the beginning of it. In other words, in accordance with at least some embodiments, the betting progress indicator continues to progress (and a current betting cycle is not closed) until the loop, oval, circle or other shape being traced or output by the betting progress indicator closes such that there is no gap or opening in the shape.

In accordance with some embodiments, the betting progress indicator may be initiated only after one or more preliminary events (e.g., bets) of a betting cycle or other game aspect occur. Thus, for example, in a Texas Hold'Em poker game in which the player in the Small Blind position is required to post or place an initial bet amount of a certain magnitude (e.g., half of the minimum bet amount for the game) and the player in the Big Blind position is required to post or place an initial bet amount that is greater than that of the player in the Small Blind position (e.g., the minimum bet amount for the game), the program controlling or directing the adjustment or progression of a betting progress indicator may comprise instructions causing it to not initiate an indication of betting progress (e.g., not begin the bar) with the position of the Small Blind, but rather initiate it with the position of the Big Blind (since the betting progress indicator would necessarily always need to be reset when the player in the Big Blind posts or places the larger wager amount in such embodiments). In other embodiments, the betting progress indicator may be initiated with the Small Blind and simply reset when it gets to the Big Blind.

Returning now to FIG. 4A, illustrated therein is an embodiment in which the betting progress indicator 410 is initiated with player 407 in the Big Blind position. The betting decision is now with player 401, the current bet is $2000 and area 420 indicates the betting options for player 401: (i) Call the current bet of $2000; (ii) Raise the current bet (there is an amount of $6000 shown but the player may adjust this amount using the slide bar in area 420); or (iii) Fold.

Figure 4B:
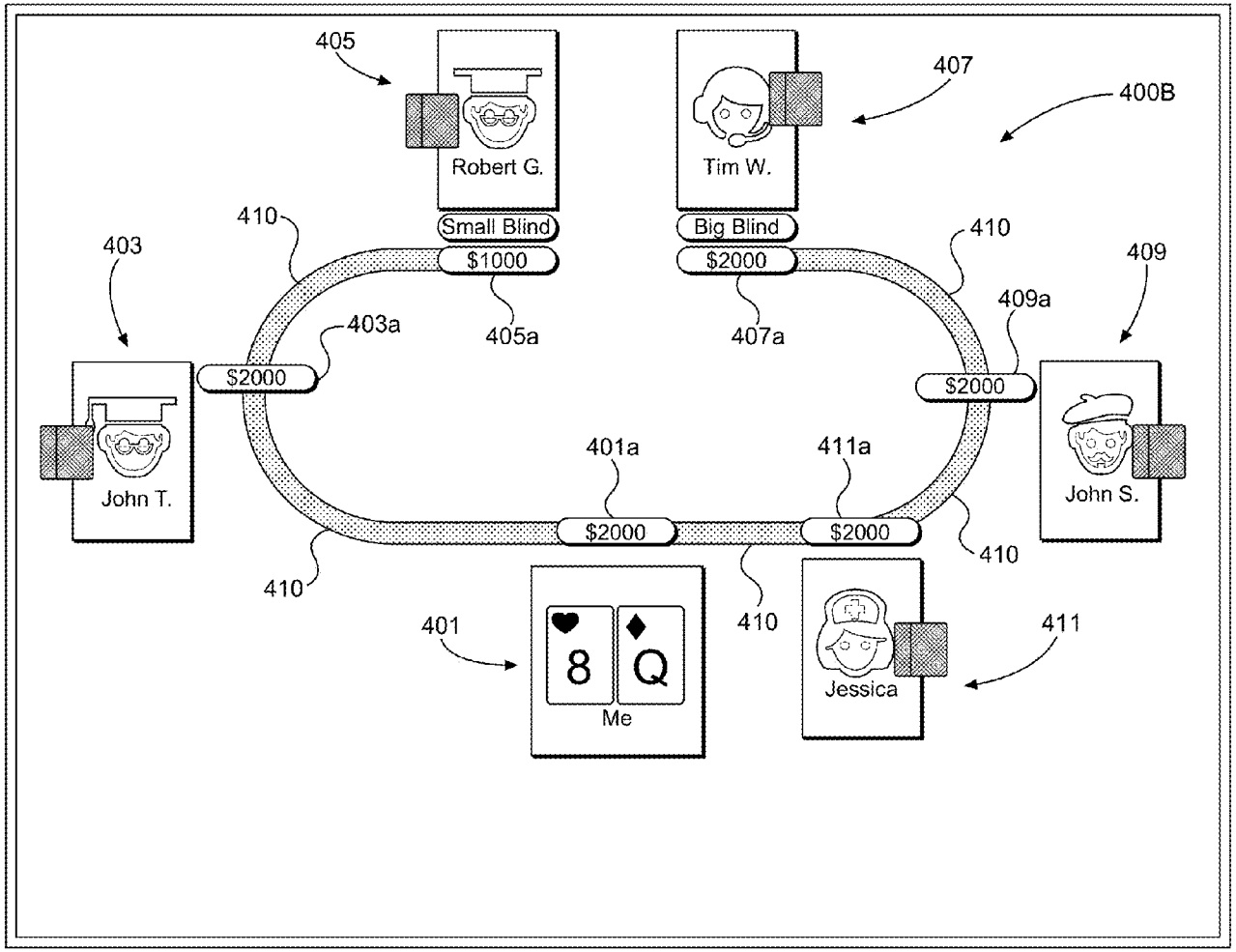

Turning now to FIG. 4B, illustrated therein is a screen shot 400B illustrating what happened after the betting decision scenario presented in FIG. 4A. The advancement of the betting progress indicator 410 illustrates that player 401 Called the $2000 bet amount, as did player 403, such that the betting progress indicator 410 continued to advance to player 405. The betting decision in the current betting cycle is now with player 405, who is at the player position labeled "Small Blind."

In accordance with some embodiments, if player 405 in the situation of FIG. 4B also Calls the current bet by adding another $1000 to the pot, the betting cycle ends and no additional betting cycle for the hand will be necessary or allowed, which may be illustrated by the betting progress indicator 410 completing or closing by advancing to where it was initiated, at player 407. In accordance with some embodiments, in such a scenario the advancement to player 407 would not indicate that the betting decision for the current cycle is now with player 407; the advancement of the betting progress indicator to a position at which the betting progress indicator was initiated would signify the end of the current betting cycle. In some embodiments, the current betting cycle may not end until the player in the Big Blind position Checks (i.e., declines his option to Raise). In a game comprising multiple stages or rounds of betting (e.g., Pre-Flop, Flop and River betting cycles in a Texas Hold'Em game), a new betting cycle may be initiated for the next stage or round of betting (assuming the round or stage for which betting has been closed is not the final stage or round of the hand) once the current round of betting has been closed.

It should be noted that area 420, for indicating to a player the betting choices available to him, is not show in the screen shot 400B. This is because, in accordance with one embodiment, the screen shots are from the perspective of player 401 and, in the screen shot 400B, it is not player 401's turn to bet. Since player 401 is not required to make a betting decision at this time, the betting choices in area 420 are not illustrated. Of course in other embodiments the area 420 (or another area for making player selections and betting choices) may be visible to a subject player even when it is not that player's turn to bet (e.g., in a greyed-out or disabled manner or in a fully functional manner (with perhaps a delay in implementing the player's betting decision until it is that player's turn to make a betting decision)).

Figure 4C:
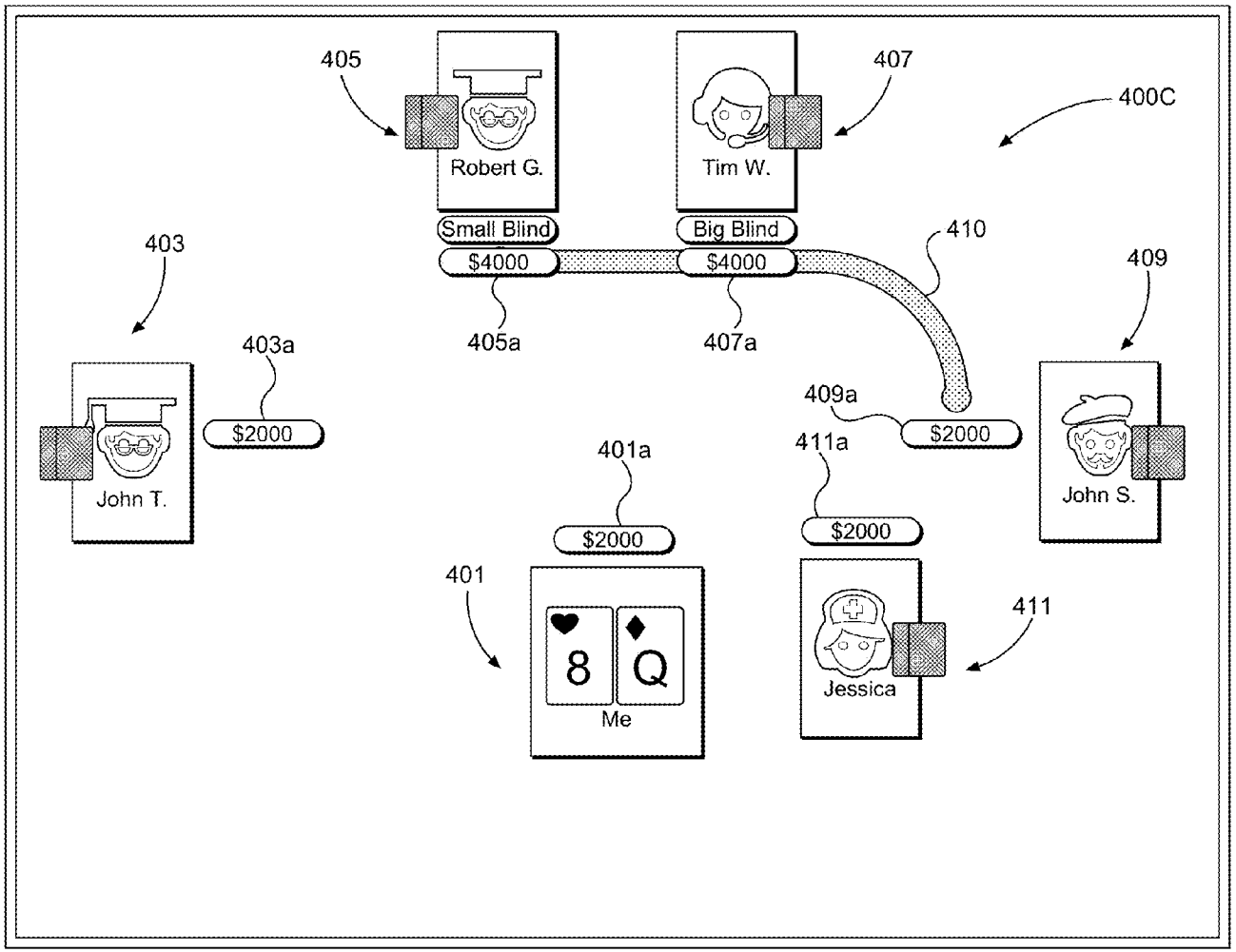

Turning now to FIG. 4C, illustrated therein is a screen shot 400C of what happened after the betting scenario presented in FIG. 4B. As previously described, in the embodiment of FIGS. 4A-4F, the betting progress indicator 410 resets (i.e., is restarted or reinitiated from the player position at which it is restarted or reinitiated) once a player decision triggers a re-opening of betting in a betting round, or another game event is determined or recognized which triggers a resetting of the betting progress indicator. If, on the other hand, a player decision is one which causes betting for the hand to continue (e.g., the player Calls the current bet amount) the betting progress indicator continues to advance past the current player's position and on to the next participating player's position in a continuous manner. Thus, any given player participating in the current hand who has not Folded may easily and visually determine whether he/she will need to make another betting decision in the current betting round by looking at the betting progress indicator: if the betting progress indicator has already progressed past the subject player's position and continued to advance along its designated path towards the player position at which it was initiated (forming a closed loop or other shape once it advances to the player position at which it was initiated) without having been reset, this indicates to the subject player that he/she will not need to make another betting decision in the current betting round because a new betting cycle has not been triggered. If, on the other hand, the subject player sees that the betting progress indicator has been reset at a position past his/her position, such that the betting progress indicator will have to again advance through his/her position in order to form the closed loop or shape by advancing to the player position at which it was initiated, this will inform the subject player that he/she will be required to make another betting decision in the current betting round because another betting cycle has been initiated for the current betting round.

In the particular scenario illustrated via FIG. 4C, it is shown that player 405, upon being presented with a betting decision as shown in FIG. 4B, elected to Raise the bet amount to $4000, which caused the progress indicator 410 to restart at that player's position, indicating that betting has been re-opened for the current betting round (or other stage of the hand) and every other player who has not Folded will need to make a betting decision in this new betting cycle of the current betting round. As also illustrated in FIG. 4C, player 407 Called the $4000 bet amount. Thus, the betting progress indicator 410 (which was reset at player 405 position when the bet amount was Raised and a new betting cycle initiated) advanced past the position of player 407 and the betting decision for the current betting cycle is now with player 409. Thus, player 401 can easily see that he will be next in making a betting decision for the current betting cycle (whether player 409 initiated a yet newer betting cycle or the current betting cycle is maintained at he current bet amount of $4000) and that betting has not yet closed for the current betting round because of the betting decision of player 405, which initiated a new betting cycle as indicated by the resetting of betting progress indicator 410.

Figure 4D:
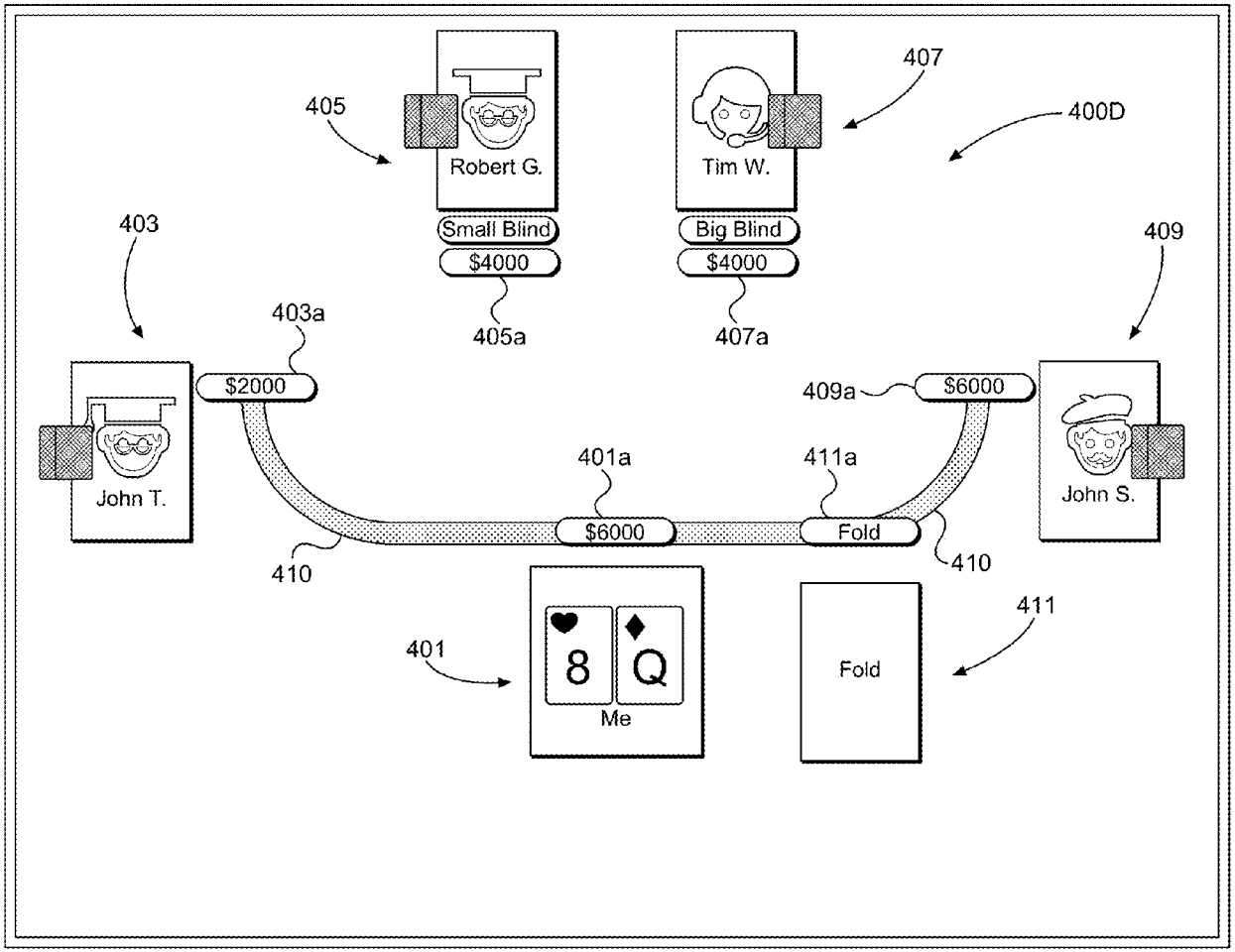

Turning now to FIG. 4D, as the example betting scenario from FIG. 4C continues, screen shot 400D illustrates that player 409 raised the bet to $6000, thus again causing the betting progress indicator 410 to be reset (starting from player 409's position) to indicate that a new betting cycle has been initiated for the current betting round. Screen shot 400D further illustrates that after the betting decision of 409 to raise the bet amount to $6000, player 411 Folded (which, in accordance with some embodiments, did not cause the betting progress indicator to be reset), player 401 Called (resulting in the betting progress indicator 410 advancing past player 401's position) and that the betting decision now rests with player 403.

Figure 4E:
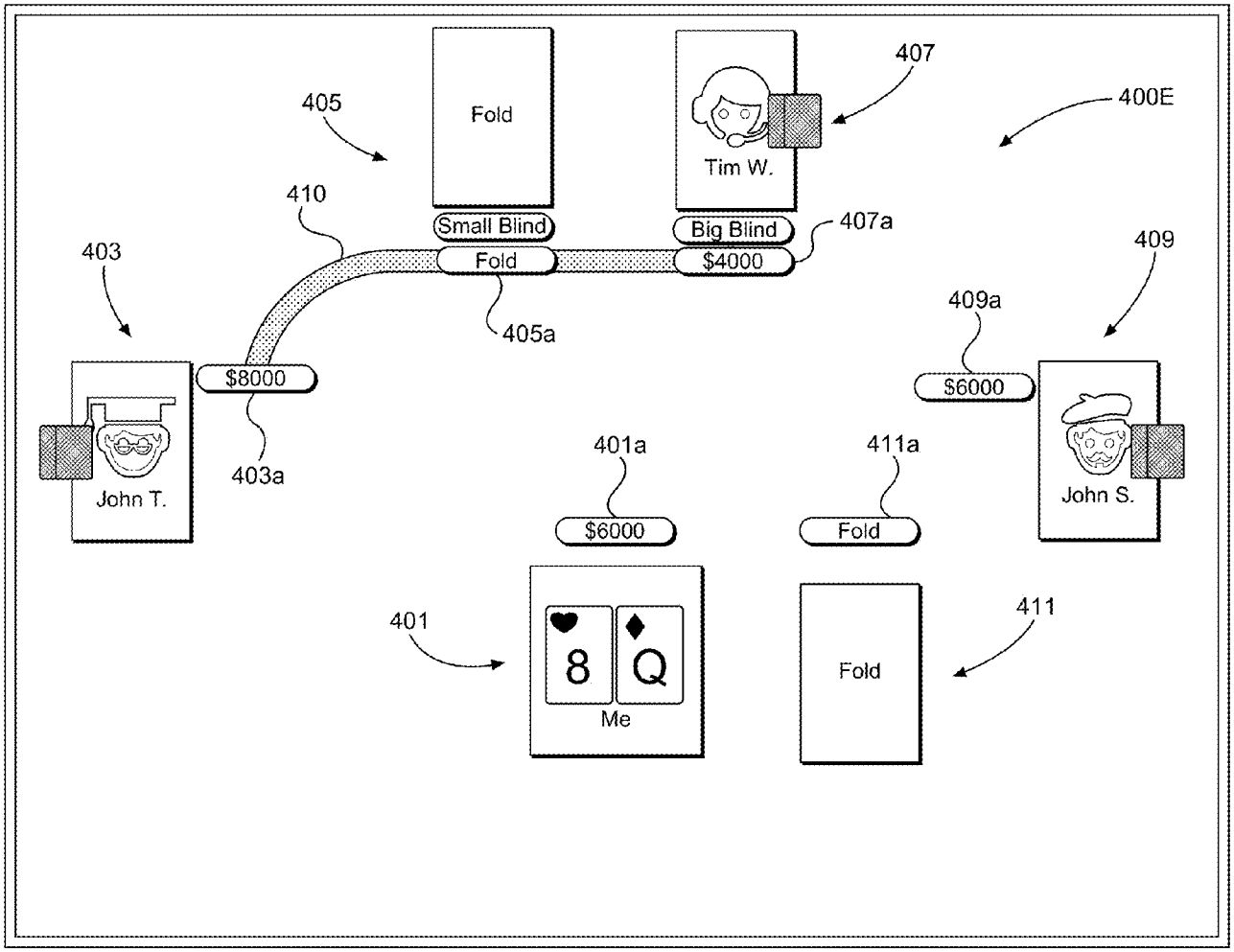

Turning now to FIG. 4E, which continues the illustrative betting scenario of FIG. 4D, screen shot 400E illustrates that player 403 Raised the bet to $8,000, thus again causing the betting progress indicator 410 to be reset (starting from player 403's position) to indicate that a new betting cycle has been initiated for the current betting round. Screen shot 400D further illustrates that after the betting decision of 403 to raise the bet amount to $8000, player 405 Folded (which, in accordance with some embodiments, did not cause the betting progress indicator to be reset) and that the betting decision now rests with player 407.

It should be noted that in the example embodiment of FIG. 4E, an image of a player who Folded is removed from the interface (e.g., the player's name, picture or other representation or indication of the player is removed from the virtual table illustration) and only an indication of that players position and status remains but in other embodiments an indication of the player may continue to be represented (e.g., but as grayed out, or otherwise depicted as no longer participating in the hand).

In the embodiment of screen shot 400E, player 407 may now choose to Fold or Call (by adding an extra $2000 to the pot to increase his bet amount from $6000 to $8000) but cannot further Raise the bet amount because $8000 is the maximum bet amount. The maximum bet amount for the current round was illustrated in area 420 of FIG. 4A.

Figure 4F:
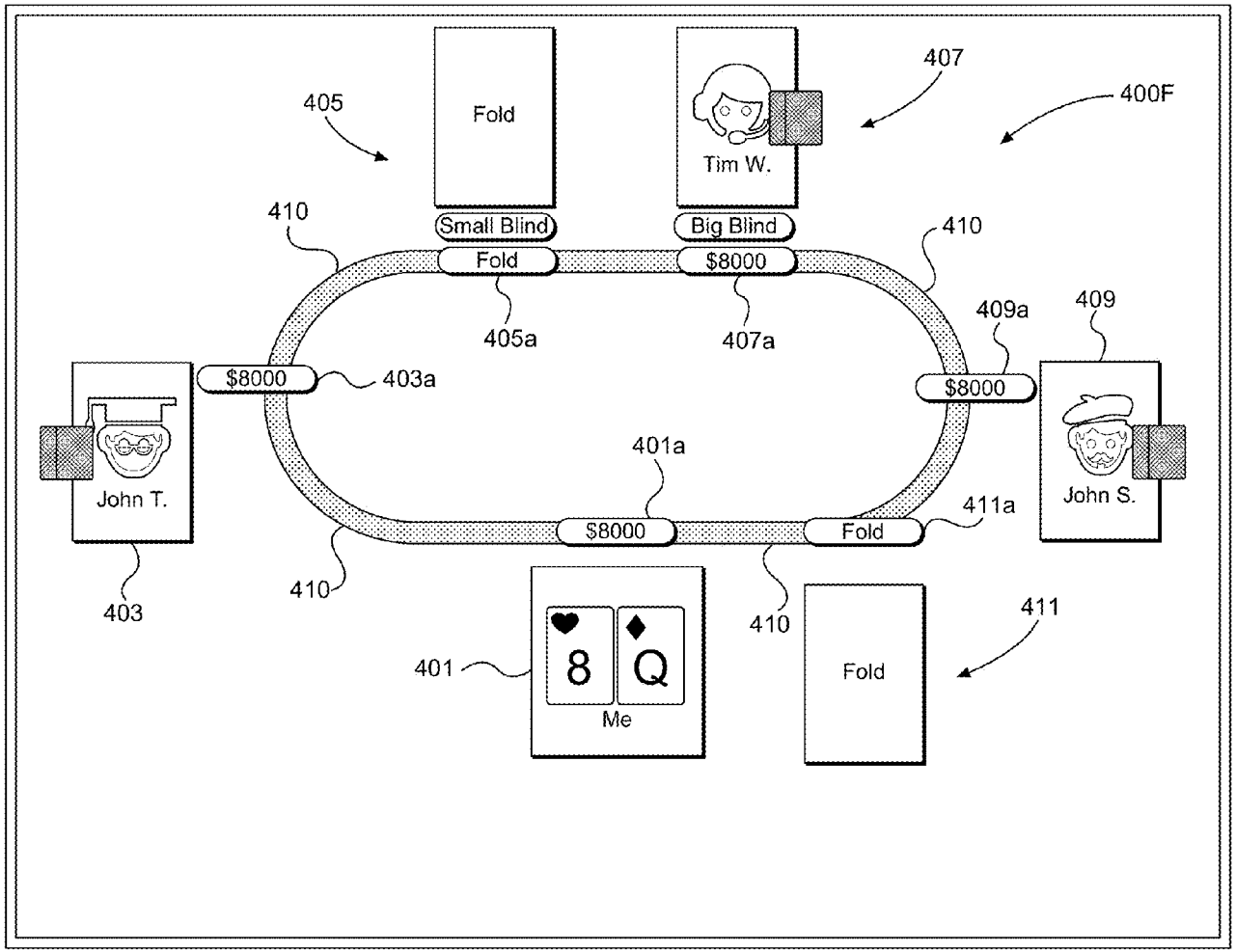

Turning to FIG. 4F, screen shot 400F illustrates, via the betting progress indicator 410, that betting for the current betting round is now closed and no other player will be required to make a further betting decision in the current betting round (since the end of the betting progress indicator 410 has reached the position at which it was initiated, thus completing a closed loop along the oval shaped track which the betting progress indicator was tracing in this particular embodiment). Since the screen shot of FIG. 4E, it can be seen that player 407 Called the $8000 bet, as did players 409 and 401. Thus, the resolution of the hand (or round, if it is a hand comprising multiple rounds of betting) may now be determined or the next round or stage of betting for the hand may begin, depending on the rules of the game being played.

The methods, interfaces and systems illustrated in the screen shots of FIGS. 4A through 4F comprise one example embodiment of how a status of betting, or betting decisions for a current hand or round, may be represented in a clear and uncluttered fashion such that any given player participating in a hand may be able to easily and efficiently discern information such as whether the player will need to make another betting decision (e.g., whether betting has been re-opened by a betting decision of another player), what betting decisions have already been made for the current betting cycle and the current bet value for the hand.

Of course, various modifications or alternatives may be employed to the embodiments of FIGS. 4A through 4F within the spirit and scope of the invention(s) described herein. FIGS. 5A through 5B, FIG. 6, FIGS. 7A through 7F and FIGS. 8A through 8D illustrate some possible variations in how information may be output (and what type of information may be output) to players of an electronic card game.

Figure 5A:
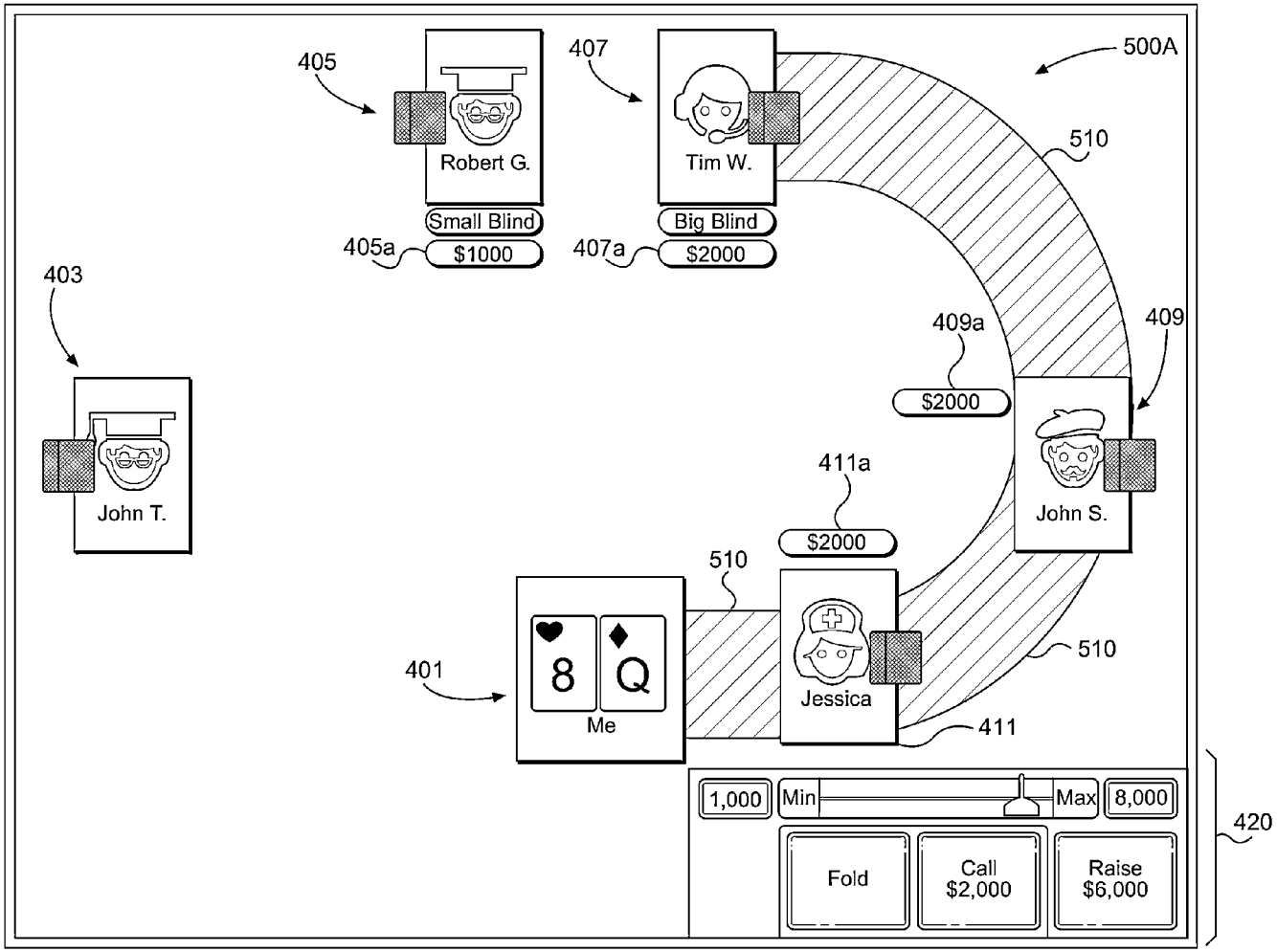
FIGS. 5A and 5B together illustrate one example embodiment of a game interface (e.g., a screen shot of an online game) for facilitating an online card game, as it is modified based on bet decisions of players over the course of a hand of the card game, in a manner consistent with one or more embodiments described herein.
Figure 5B:
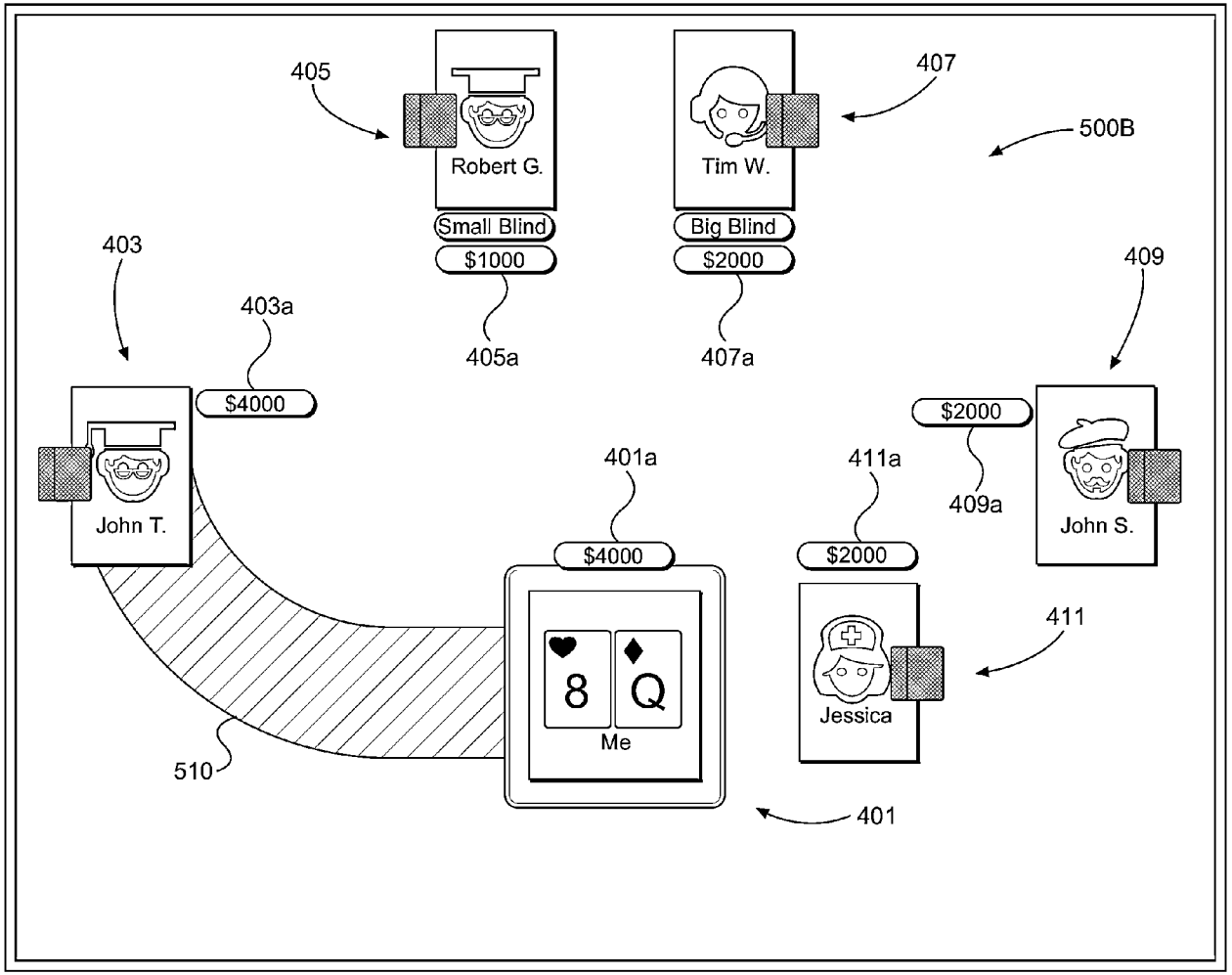

For example, in the alternate embodiments of FIGS. 5A through 5B, the screen shots 500A through 500B illustrate how a betting progress indicator 510 may be used in a fashion similar to the betting progress indicator 410 of FIGS. 400A through 400F, but rather than the betting progress indicator being progressed along a track illustrated in front of icons or illustrations representative of player positions/players, the betting progress indicator 510 is illustrated as progressing in a track which appears to move underneath the player position illustrations (which may be referred to as "player pods"). In accordance with some embodiments, a player pod is highlighted or otherwise distinctly indicated as the betting progress indicator 510 progresses to the player pod.

Figure 6:
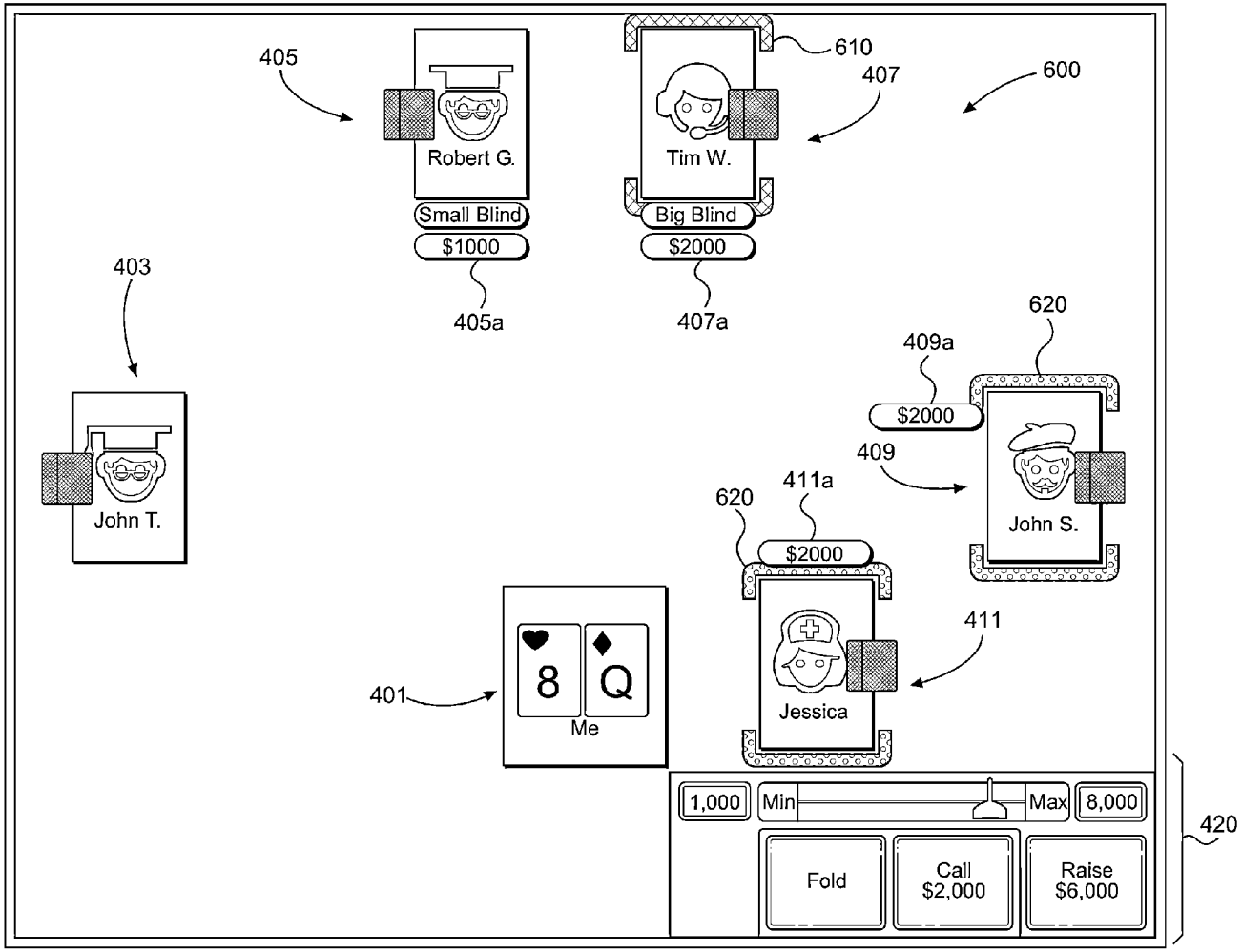
FIG. 6 is an illustration of an example embodiment of a game interface (e.g., a screen shot of an online game) for facilitating an online card game in a manner consistent with one or more embodiments described herein.

Turning now to FIG. 6, yet another embodiment of how progression of betting may be tracked and illustrated comprises highlighting the player pods as betting moves to the player position at the player pod (as an alternative to using a bar-like betting progress indicator which connects the player pods, such as the betting progress indicator 510 of FIGS. 5A through 5B, or a bar-like betting progress indicator which progresses along a track in front of the player pods, such as the betting progress indicator 410 of FIGS. 4A through 4F). In some embodiments, the highlighting of player pods or player positions such as that done in the embodiments of FIG. 6 may be done via use of different colors or other differentiating characteristics to indicate different betting decisions of the respective players. For example, a player pod may be highlighted in green to indicate the player Raised, in blue to indicate the player Called, etc. In the example embodiments illustrated in FIG. 6, different patterns in the highlighting brackets 610 (to show a player has Raised the bet) and 320 (to show that the player has Called the bet) are used to indicate different betting decisions of players.

Turning now to FIGS. 7A through 7F, illustrated therein is an embodiment in which a bar (e.g., such as betting progress indicator 410 of FIGS. 4A through 4F) is used to indicate the progress of betting for a hand. However, rather than the bar-like betting progress indicator "resetting" (such that the progression or advancement of the betting progress indicator up to the point of resetting is removed from the screen and a new betting progress indicator is shown as originating at the player position at which a betting decision caused betting for a betting round or hand to be re-opened), the bar-like betting progress indicator persists or continues for the entire betting round or hand, with a re-opening of betting (e.g., which triggers a new betting cycle when a player Raises a bet amount) being indicated be a new color or other visually-discernible characteristic of the betting progress indicator. In accordance with one particular embodiment, the betting progress indicator may progress in a spiral pattern as betting continues for the hand or round of the hand, with different color segments of the bar in the spiral being indicative of betting being re-opened for the hand or round of the hand (e.g., new betting cycles being initiated due to a player Raising a bet).

Figure 7A:
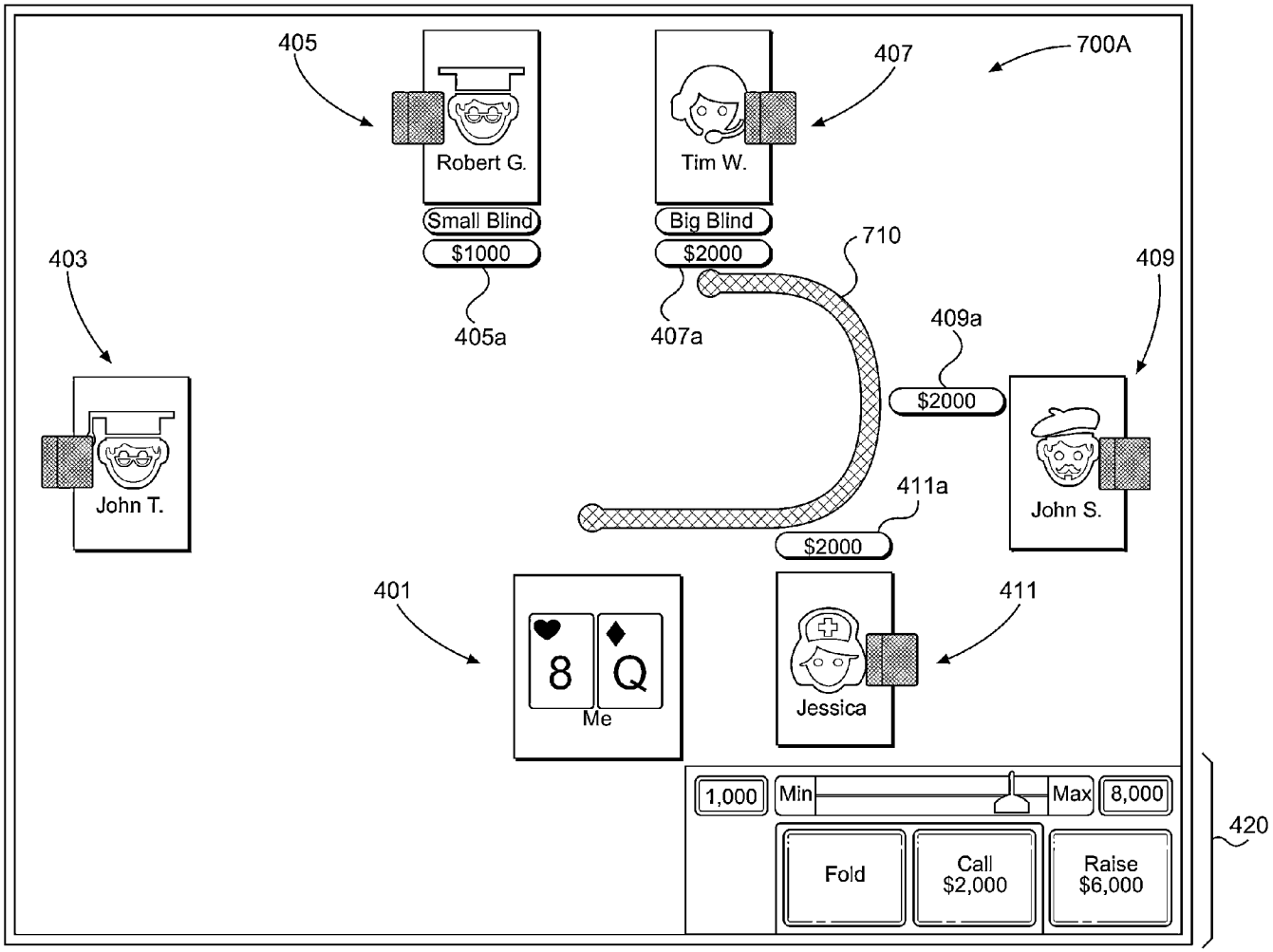
FIGS. 7A through 7F together illustrate one example embodiment of a game interface (e.g., a screen shot of an online game) for facilitating an online card game, as it is modified based on bet decisions of players over the course of a hand of the card game, in a manner consistent with one or more embodiments described herein.

For example, turning to FIG. 7A, the screen shot 700A shows the betting progress indicator in a first pattern 710 as betting progresses from player 407 to player 409 (who Called the $2000 bet initiated by player 407), then to player 411 (who also Called the $2000 bet amount) and indicates that the betting decision now rests with player 401. Thus far in the betting for the hand, the bet has remained at $2,000 and there has been only one betting cycle for the current round (not counting the Raise by player 407 in the Big Blind position from the amount bet by player 405 in the Small Blind position).

Figure 7B:
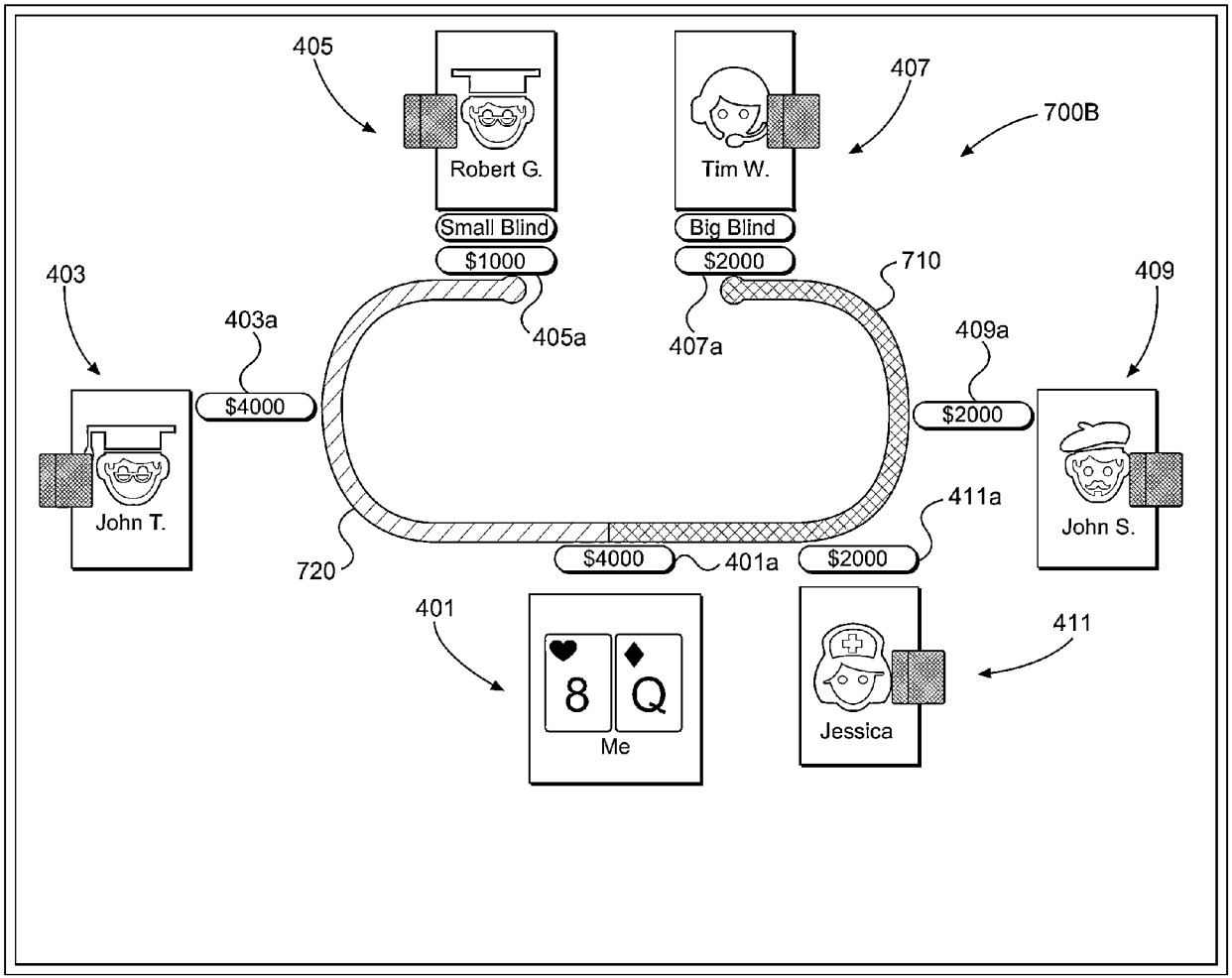

Turning now to FIG. 7B, screen shot 700B (which shows the progress in betting for the current betting round since that shown in FIG. 7A) illustrates that player 401 Raised the bet amount to $4,000 and thus caused the betting progress indicator to change to a new pattern 720 (to show that a new betting cycle was initiated with the betting decision of player 401). The betting progress indicator then progressed in the pattern 720 to player 403, who Called the bet amount of $4000 (as indicated in player 403's current bet amount area 403*a*) and thus the betting progress indicator continued to advance in the pattern 720 to the position of player 405. The ending of the betting progress indicator by player 405, along with the fact that the end of the betting progress indicator in the latest pattern or color has not yet returned to the position of the player with whom it was initiated), indicates to all players that the betting decision now rests with player 405.

Figure 7C:
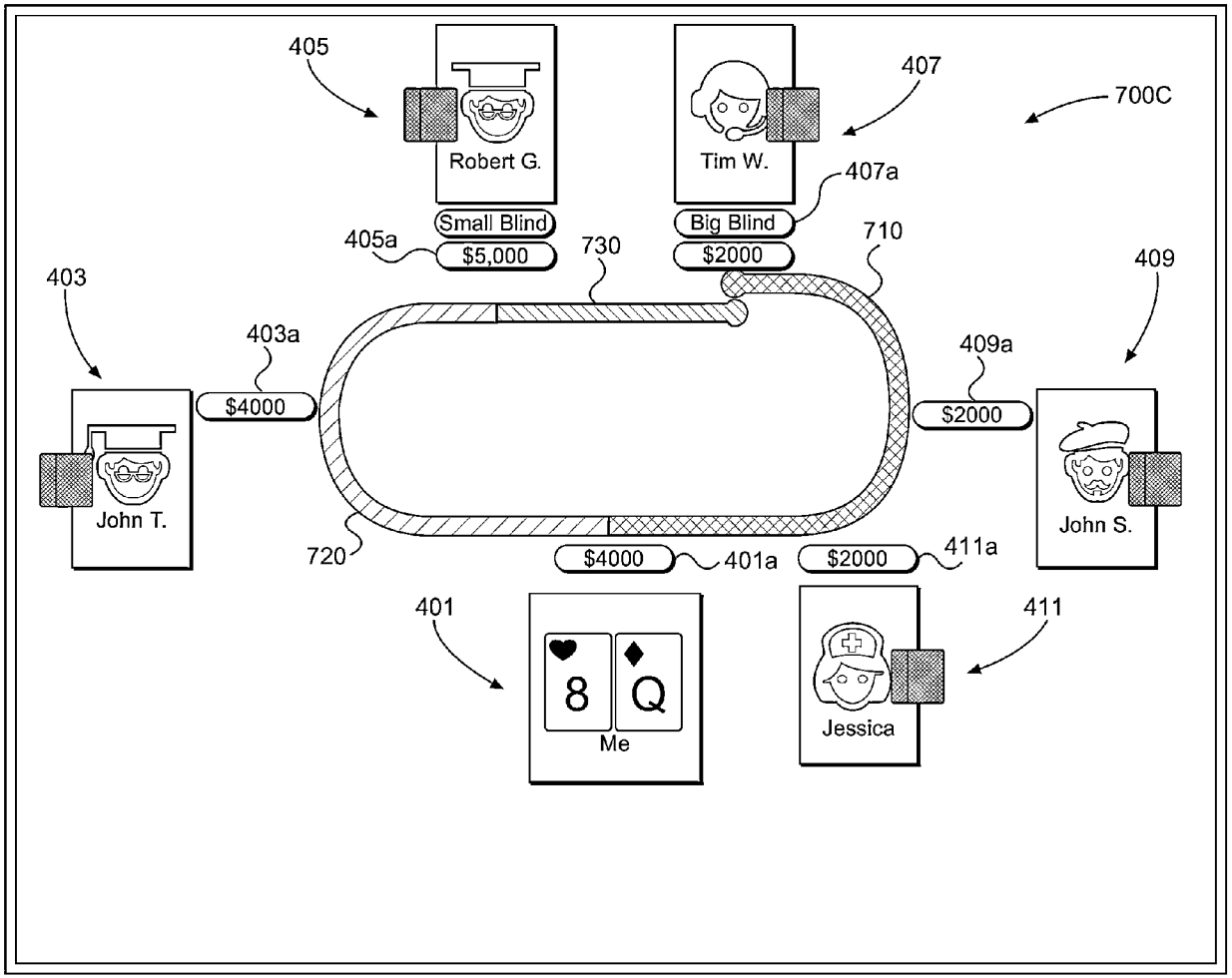

Turning to FIG. 7C and screen shot 700C (which shows the progress in betting for the current betting round since that shown in FIG. 7B), the appearance of a new pattern 730 in the betting progress indicator beginning with player 405 indicates that this player Raised the bet (to $5,000) and thus a new betting cycle has been initiated for the current betting round such that all other players who have not Folded will be required to make another betting decision before the current betting round is closed. A betting decision now rests with player 407.

Figure 7D:
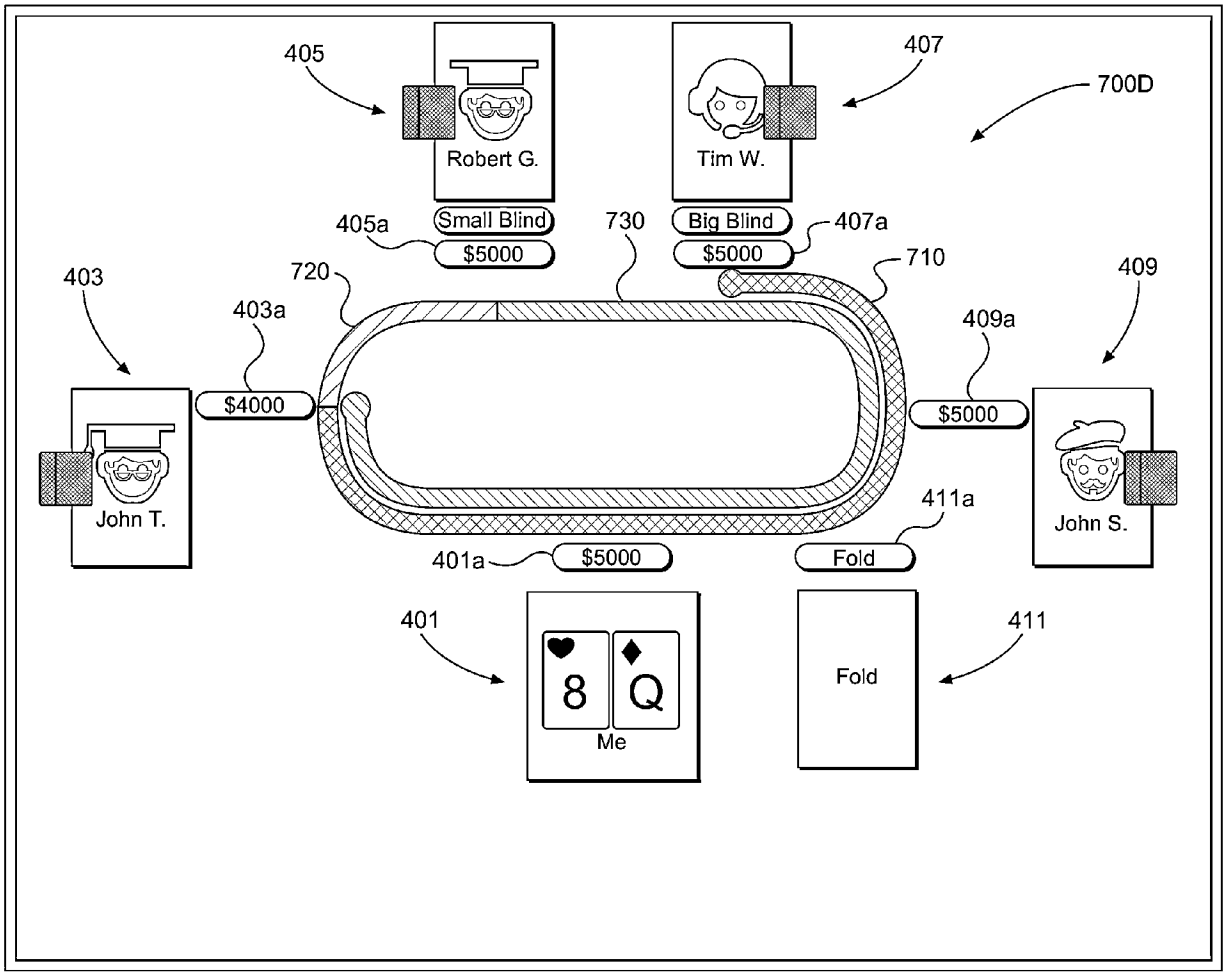

Turning now to FIG. 7D, the screen shot 700D (which shows the progress in betting for the current betting round since that shown in FIG. 7C) illustrates that the bet amount of $5,000 has not been Raised, since the betting progress indicator has continued in the pattern 730 from player 405 to player 407 (who Called the bet), to player 409 (who also called the bet), to player 411 (who Folded), to player 401 (who Called the bet) and then on to player 403. The betting decision now rests with player 403, as indicated by the fact that the betting progress indicator in the current pattern has stopped at this player position prior to having returned to the player position at which the current pattern was initiated. Thus, if player 403 also Calls the bet, the betting progress indicator will continue in the current pattern 730 to player 405, thus ending betting for the current betting round or hand (since player 405 initiated the $5000 bet amount and the current pattern 730 of the betting progress indicator).

Figure 7E:
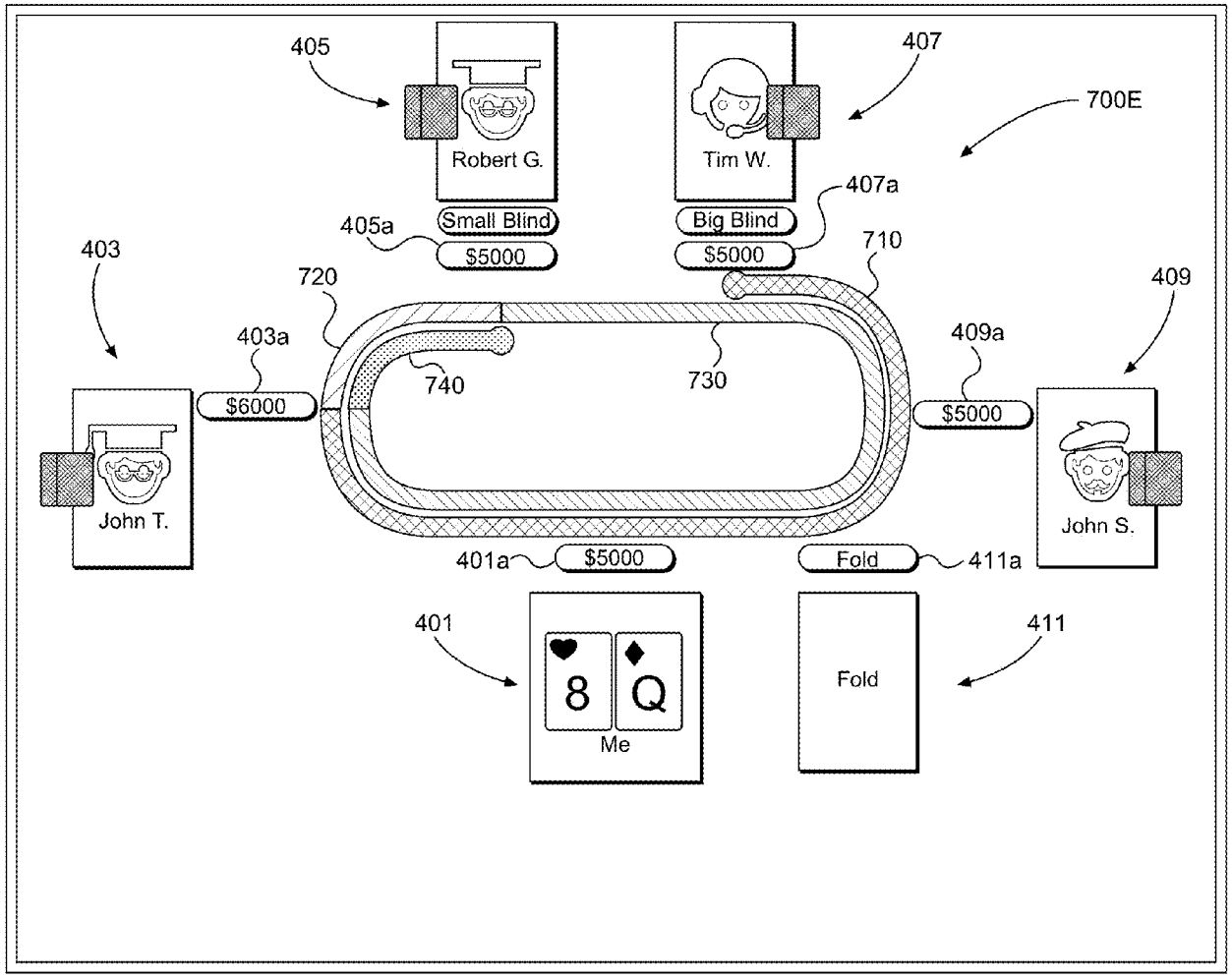

Turning now to FIG. 7E, screen shot 700E of FIG. 7E (which shows the progress in betting for the current betting round since that shown in FIG. 7D) illustrates that player 403 Raised the bet amount to $6,000, thus initiating a new betting cycle for the current betting round and causing the betting progress indicator to be reset to a new pattern 440 to illustrate that a new betting cycle has been initiated by the betting decision of player 403. Thus, all participating players are informed via the new pattern in the betting progress indicator that any player positioned after (in a clockwise direction) player 403 (so long as they have not Folded) will be required to make another betting decision in the current betting round. The betting decision now rests with player 405.

Figure 7F:
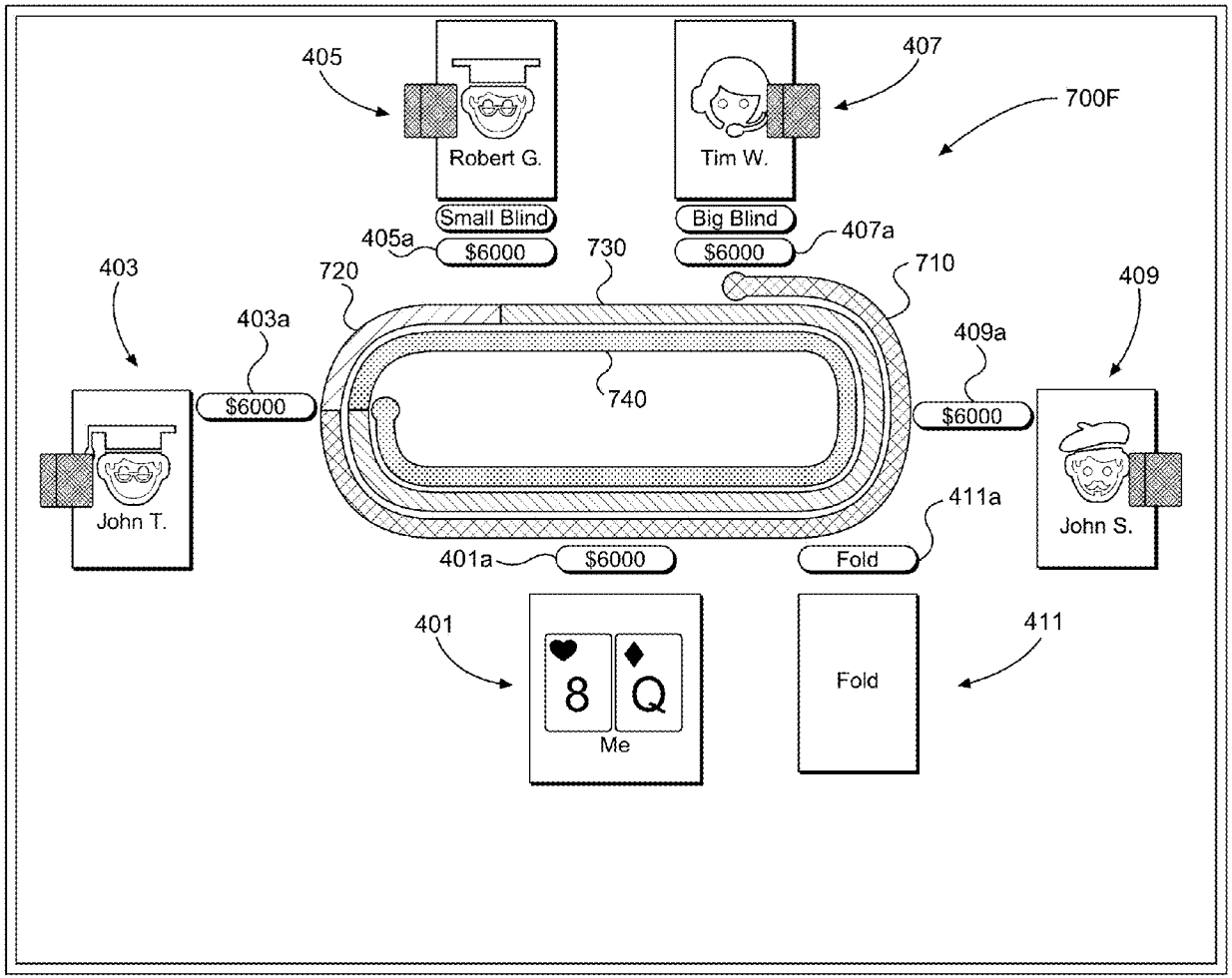

Turning now to FIG. 7F (which shows the progress in betting for the current betting round since that shown in FIG. 7E), screen shot 700F illustrates that the betting progress indicator has advanced in its current pattern 740 along its track from player 403 to player 405 (who Called the $6000 bet), to player 407 (who also Called the $6000 bet) to player 409 (who also Called the $6000 bet), past player 411 (who had previously Folded), to player 401 (who also Called the $6000 bet) and finally back to player 403. Since player 403 is the player who had caused the betting progress indicator in its current pattern, when the betting progress indicator in its current pattern 740 returns to the player position at which it originated, betting for the current betting round or hand is determined to be closed (player 403 is not given an opportunity to bet again in this current betting round when the betting progress indicator in its current pattern advances to his position).

The embodiment illustrated in FIG. 7A through 7F provides, in an easily discernible manner, how many betting cycles occurred for a given hand (or given round or stage of a hand) and which player caused each respective Raise in bet. Of course, one of ordinary skill in the art, upon reading the present disclosure, would understand that other types of additional information may also be depicted by different uses of illustrations which indicate progress of betting for a hand or round of a hand. It should be noted that although different patterns of the betting progress indicator are used to illustrated occurrences of betting decisions which cause a re-opening of betting for a hand or round of a hand, the embodiments are not limited to uses of different patterns. Any differences in appearance of the betting progress indicator may be used. For example, different shapes, contours, thicknesses, colors or brightness of the betting progress indicator may be used to achieve similar goals. For example, in one embodiment a three-dimensional (3-D) ramp or other representation may be used to illustrate the various betting cycles in a given hand or round of a hand, wherein a new level being added to the ramp indicates a re-opening of betting while a completion of a closed loop on a given level indicates that a cycle of betting was closed without betting being re-opened by a player decision. In any of these embodiments, a betting progress indicator may be considered to be "reset" when its appearance is modified or changed (e.g., the color or pattern is changed) in response to a predetermined betting decision of a player (e.g., in response to a player Raising the bet amount for the current hand or round of the hand).

Turning now to FIGS. 8A through 8D, illustrated therein is an embodiment in which the resetting of a betting cycle (or re-opening of betting for a given hand or round of a hand) based on a bet decision of a player is indicated by a change in pattern of the betting progress indicator (as in FIGS. 7A through 7F), but wherein the betting progress indicator does not continue throughout the round of a hand (or hand) in a spiral pattern, turning into a decreasing oval pattern such that all the betting cycles and corresponding patterns for a betting round may be viewed at the end of the betting round. Rather, the betting progress indicator which indicates the progress or status of betting is superimposed upon, or replaces, any previously-generated betting progress indicator portion along the track if betting continues to progress to betting positions of which player have previously made betting decisions in previous betting cycles of the hand or round. Thus, as can be seen from screen shot 800A of FIG. 8A, the betting progress indicator being initiated in a first pattern 810 with the betting decision of player 407 (who raised the bet from $1000 to $2000). The betting progress indicator then advanced in the first pattern 810 to player 409 (who Called the bet), player 411 (who also called then bet) and then to player 401 (with whom the betting decision now rests).

Figure 8A:
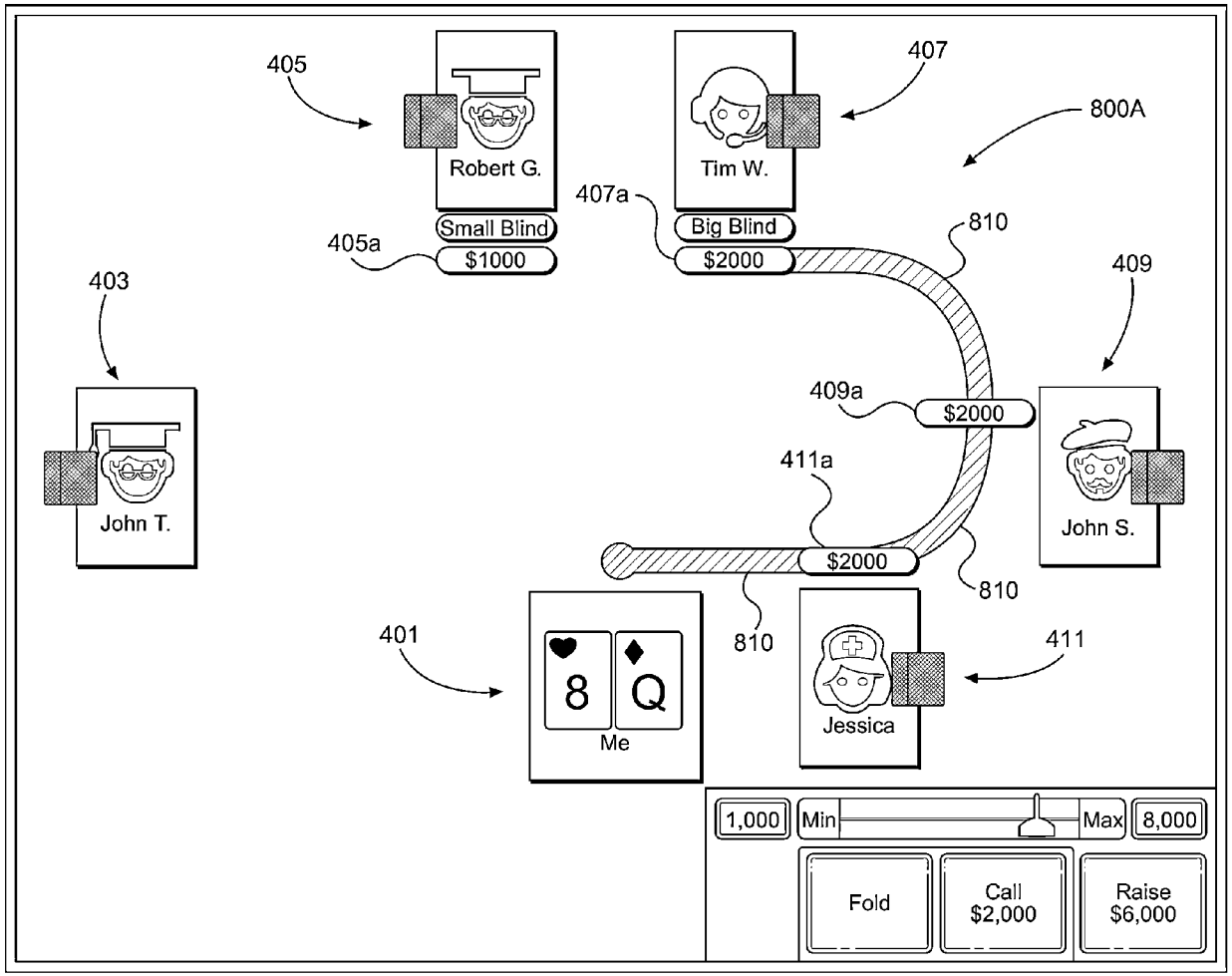
FIGS. 8A through 8D together illustrate one example embodiment of a game interface (e.g., a screen shot of an online game) for facilitating an online card game, as it is modified based on bet decisions of players over the course of a hand of the card game, in a manner consistent with one or more embodiments described herein.
Figure 8B:
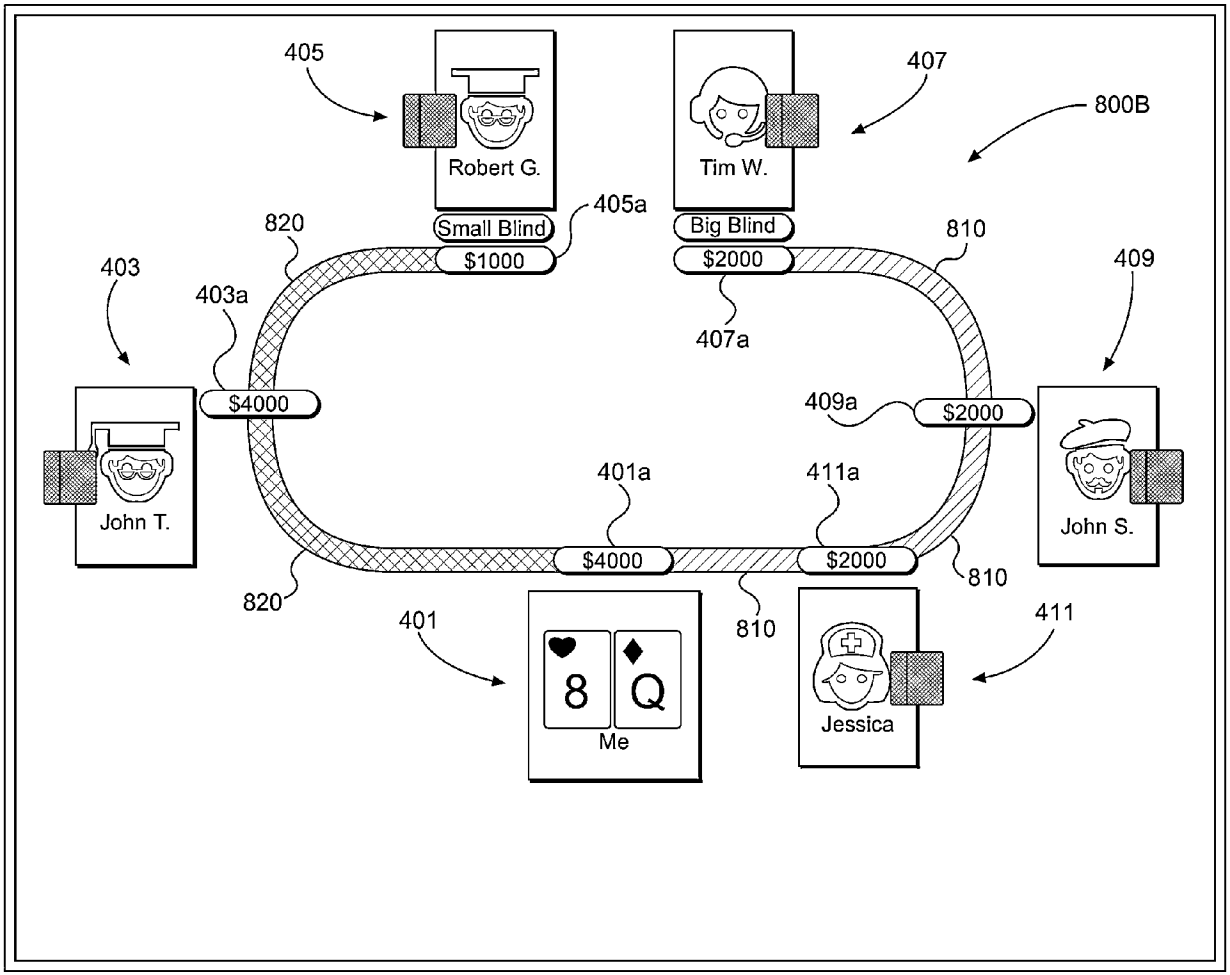

Turning now to FIG. 8B, screen shot 800B (which shows the progress in betting for the current betting round since that shown in FIG. 8A) illustrates that betting for the current hand or round was re-opened by the decision of player 401 to Raise the bet to $4,000. In accordance with some embodiments, the betting progress indicator was thus reset to a new pattern 820 beginning with the position of player 401, to indicate the initiation of a new betting cycle for the hand with the betting decision of player 401. The betting progress indicator then advanced in the new pattern 820 to player 403 (who Called) and then to player 405, with whom the betting decision now rests.

Figure 8C:
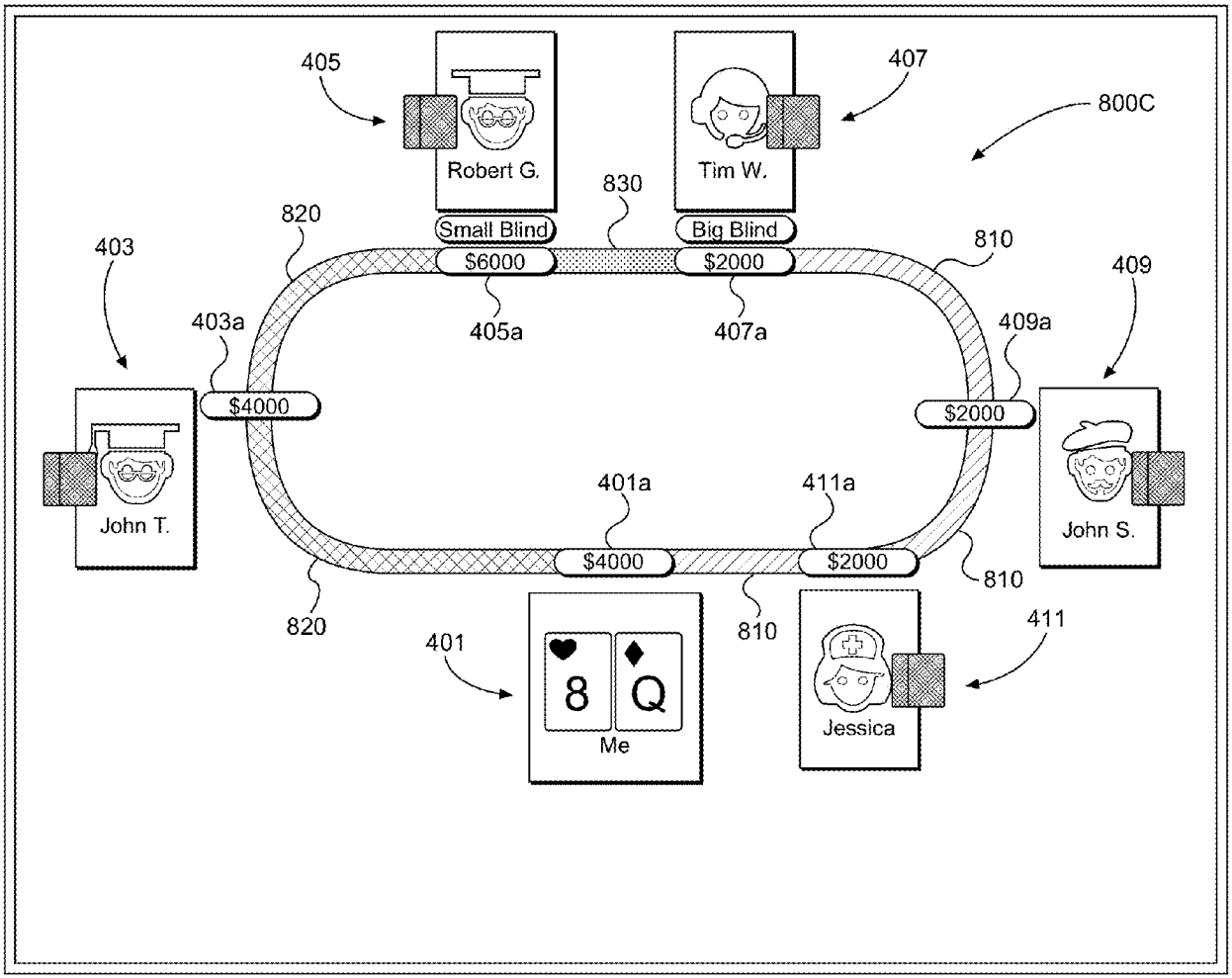

Turning now to FIG. 8C, screen shot 800C (which shows the progress in betting for the current betting round since that shown in FIG. 8B) illustrates that player 405 Raised the bet for the current round of the hand to $6,000, thus re-opening betting for the round as represented by the new pattern 830 for the betting progress indicator, which was initiated at the position of player 405. The betting decision now rests with player 407. It should be noted that although the betting progress indicator appears to have formed a closed loop in the scenario of FIG. 8C, betting for the round is not closed because the betting progress indicator has not completed a full track in a given pattern, beginning the pattern at a certain player position and advancing past all other player positions in the same pattern until returning to the player position at which it had been initiated. Thus, betting for the current round remains open due to the initiation of a new betting cycle by player 405.

Figure 8D:
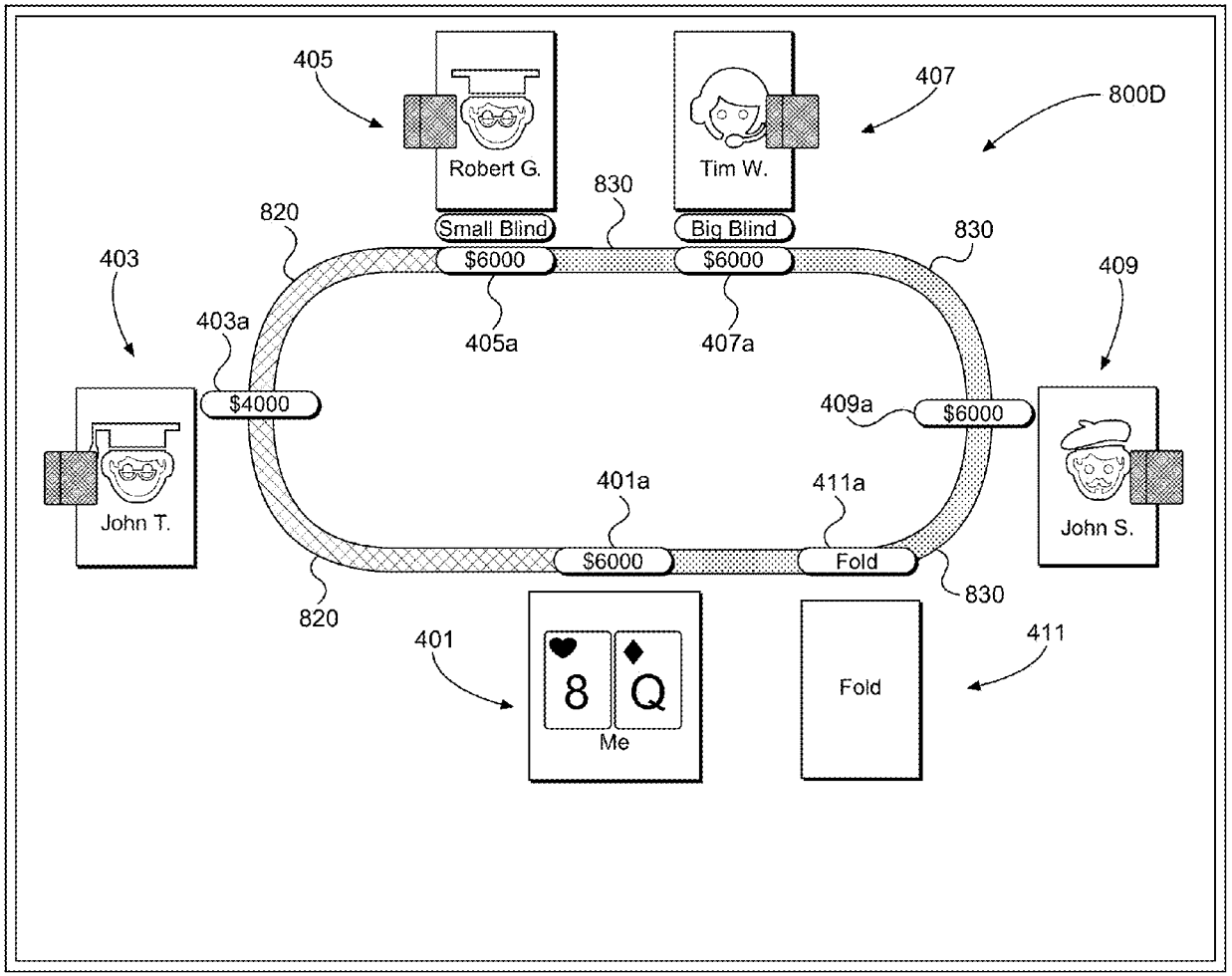

Turning now to FIG. 8D, screen shot 800D (which shows the progress in betting for the current betting round since that shown in FIG. 8C) illustrates that the betting progress indicator in the pattern 830 has continued from player 407 (who Called the $6000 bet), to player 409 (who also Called), to player 411 (who Folded) and ends at player 401, thus indicating that the current betting decision now rests with player 401. The betting progress indicator pattern 830 has replaced the previous pattern 810 in the path between players 407 and 409, between players 409 and 411, and between players 411 and 401 (as can be seen by comparing the screen shot 800D to the screen shot 800C (FIG. 8C) and/or the screen shot 800B (FIG. 8B). Thus, FIG. 8D (when considered in conjunction with FIGS. 8C and/or 8B) illustrates that, in accordance with some embodiments, a new pattern for a betting progress indicator may replace, be superimposed or subsume a previous pattern for the same portion or area of the betting progress indicator.

Of course, other modifications or design choices other than those explicitly illustrated in the Figures of the present application may be adopted without departing from the spirit and scope of the embodiments in the possession of applicants. For example, in one modification of a design for a betting progress indicator, the betting progress indicator for a round of a hand (or a hand, if multiple rounds are not part of the game) may be programmed such that it stops at the position of the player who last made a betting decision, rather than at the position of the player who is next for making a betting decision.

In accordance with some embodiments, the illustrations provided herein may be thought of as being directed to methods, systems, articles of manufacture which provide for: (i) outputting an interface which displays a respective player icon for each player position representing a player participating in a hand of a card game; (ii) determining an opening of betting for the hand by determining a bet amount indicated by the first player; (iii) outputting a betting progress indicator as beginning at the player position of the first player; (iv) causing the betting progress indicator to progress to the player position of a second player participating in the hand; (v) determining whether a bet decision of the second player re-opens betting for the hand; (vi) if the bet decision does not re-open betting for the hand, causing the betting progress indicator to advance to a player position of a third player participating in the hand; (vii) if the bet decision does re-open betting for the hand, causing the betting progress indicator to reset at the second player's player position before continuing the betting progress indicator to a player position of a third player participating in the hand; (viii) determining whether betting has closed by determining whether a player position for a current player due to make a betting decision for the hand is the player whose decision caused the betting progress indicator to be initiated or reset; and (ix) outputting an indication of a closing of the betting for the hand if the player position for the current player due to make a betting decision for the hand is the player whose decision caused the betting progress indicator to be initiated or reset. In some embodiments, resetting a betting progress indicator may comprise removing from an interface an indication of a progress of betting in a previous betting cycle and causing the betting progress indicator to be output as re-originating at a current player position. In other embodiments, resetting a betting progress indicator may comprise causing an appearance of the betting progress indicator to change from a first appearance to a second appearance from a point corresponding to a current player position (e.g., change in color, as illustrated in the embodiments of FIGS. 4A through 4G or in FIGS. 5A through 5E). In some embodiments, the betting progress indicator may comprise a bar such as bar 110 (FIGS. 1A through 1F), bar 210 (FIGS. 2A through 2D).

Further, additional information may also be represented to online players via any or all of the example interfaces without departing from the spirit and scope of the embodiments in the possession of applicants. For example, (i) the number of times the bet amount has been raised during a current betting round or hand; (ii) the increase in value of the current bet from the original bet amount to the current bet amount; or (iii) the relative investment a player has made with a current bet (e.g., in terms of the percentage of the player's total available stack of chips or bankroll).

Figure 9:
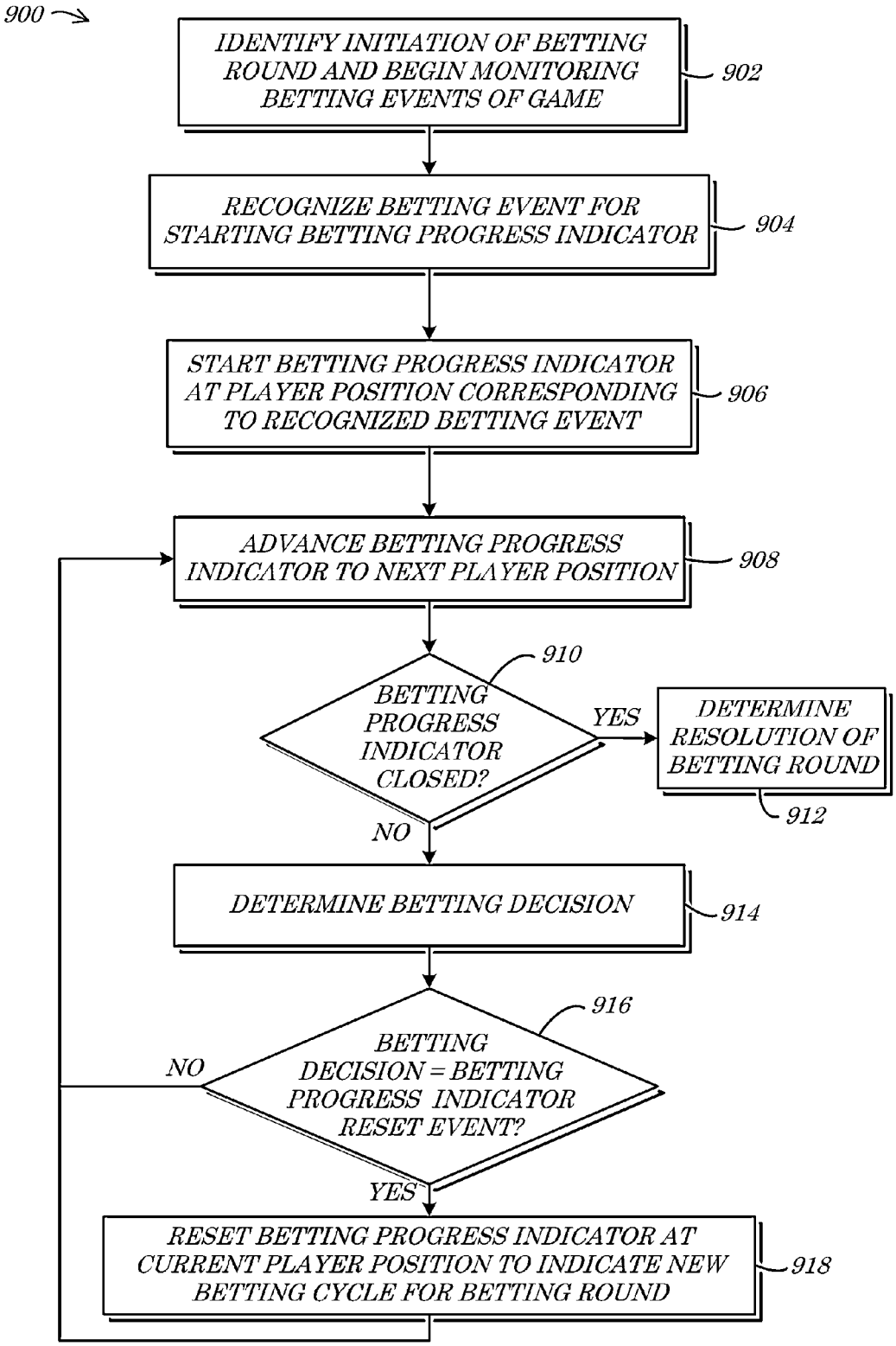
FIG. 9 is a flowchart of an example process consistent with one or more embodiments described herein.

Turning now to FIG. 9, illustrated therein is a flowchart of a process 900, which is consistent with at least some embodiments described herein. The process 900 may comprise a process for implementing the betting progress indicator feature described herein, such as determining whether to reset or advance a betting progress indicator for a given round or hand of a card game. The process 900 may be performed, for example, by at least one of a server device operable to facilitate an electronic card game and/or a player device enabling a player to play the electronic card game. For example, the process 900 may be performed by at least one of (i) a player device 102 (FIG. 1); (ii) a game server 110 (FIG. 1); (iii) a player device 202 (FIG. 2); (iv) a game server 210 (FIG. 2); and (v) apparatus 300 (FIG. 3). In accordance with some embodiments, the process 900 may comprise the Betting Progress Indicator Program 310*b* (FIG. 3). It should be noted that additional and/or different steps may be added to those depicted in FIG. 9 and that not all steps depicted in FIG. 9 are necessary to any embodiment described herein. Rather, the process 900 is one example process of how some embodiments described herein may be implemented, and should not be taken in a limiting fashion. A person of ordinary skill in the art, upon contemplation of the embodiments described herein, may make various modifications to the process 900 without departing from the spirit and scope of the embodiments in the possession of applicants.

Process 900 may begin with a step 902, in which initiation of betting for a round of a hand (or for a hand, if a hand does not include multiple rounds or stages of betting) is identified and monitoring of betting events of the game begins, for purposes of implementing the betting progress indicator feature described herein. For example, the processor implementing the Betting Progress Indicator Program 310*b* (FIG. 3) may receive an indication that a new hand has been initiated for an electronic card game (e.g., from another program and/or computing device with which it is operable to communicate). This indication may cause the process 900 to be initiated or launched. In some embodiments process 900 may be a subroutine or software module of a program for facilitating the electronic card game with which it is associated. In some embodiments, the process 900 (or another similar process for effectuating the betting progress indicator functionality) may automatically launch upon an initiation of a game or hand for a game.

In step 904, a betting event which is associated with an instruction to initiate the betting progress indicator is recognized. For example, in some embodiments the first betting event for the hand or round of a hand being monitored causes the betting progress indicator to be started. In other embodiments, only certain predetermined betting event(s) (e.g., a betting event at a certain predetermined player position, such as the Big Blind position in a Texas Hold'Em poker game) may cause the betting progress indicator to be started. Thus, in some embodiments one or more betting events (e.g., a bet placed by the player positioned in the Small Blind position in a Texas Hold'Em poker game) may be ignored for purposes of starting the betting progress indicator or not cause the betting progress indicator to be started. In one embodiment, a database of predetermined betting events (e.g., types of bets, such as Call, Raise or Fold and/or corresponding amount of bet placed) may be stored, with a corresponding instruction for operating the betting progress indicator being stored in association with each such predetermined betting event. Such a database may be stored, for example, in the memory of apparatus 300 or otherwise accessible to apparatus 300 or another device implementing process 900. In such embodiments, each betting event which occurs in the game being monitored may be compared to events in the database, to determine whether the betting event is a predetermined betting event and what corresponding instruction should be executed responsive to a recognition thereof. Once a betting event which corresponds to a starting of a betting progress indicator is recognized in step 904, the process 900 continues to step 906.

In step 906, the betting progress indicator is started at the position of the player corresponding to the betting event recognized in step 904. For example, in one embodiment data indicative of the betting event which was received or recognized in step 904 may include data indicating the player or player position corresponding to the betting event. Step 906 may comprise, for example, outputting instructions to another processor, device or program for modifying information output to the players participating in the game, such as modifying the interface of the game to include the betting progress indicator starting at the appropriate player position. In step 908, the betting progress indicator is advanced to the next player position, in a predetermined direction among the positions of the players such that it advances to the next player whose turn it is to make a betting decision if the current betting round is not closed (e.g., from the perspective of a player viewing a screen or display of an online poker game, in a clockwise direction to the next player to the right of the player whose betting decision caused the betting progress indicator to be started). In accordance with an alternate embodiment, the betting progress indicator may be started at the position of this next player with whom the next betting decision rests, rather than at the position of the player who just made a betting decision. The betting progress indicator may be advance from player position to player position in any of the manners described herein.

In step 910 it is determined whether the betting progress indicator is "closed" as a result of the advancement made in step 908. Determining whether the betting progress indicator is closed may comprise determining whether betting for the current round or hand has closed as a result of the last betting decision of a player (e.g., the player did not Raise the bet and all other players who have not Folded have had a chance to make a betting decision in the latest betting cycle). In one embodiment, step 910 may comprise determining whether the current betting round is closed as a result of the last advancement of the betting progress indicator (e.g., whether the betting progress indicator status or state is a predetermined status or state which signifies an end to betting in the current round or hand, which may be referred to herein as a "closed state" or "closed status" of the betting progress indicator). In accordance with some embodiments described herein, step 910 may comprise determining the player position at which the betting progress indicator was started (or, in accordance with the embodiments of FIGS. 6, 7A through 7F and 8A through 8D, the position at which the current pattern of the betting progress indicator was started). In some embodiments, a betting cycle may not be considered to be completed (and the betting progress indicator may not be considered to be "closed") even if visually the betting progress indicator looks like a closed loop or other shape. For example, in the embodiments of FIGS. 8A-8D, as described above, a betting progress indicator pattern may be superimposed upon or replace a previous pattern of the betting progress indicator along the same path. In some embodiments (e.g., the embodiments of FIGS. 7A through 7F) betting for a current round or hand may be determined to be closed in step 910 even if the betting progress indicator does not have the appearance of being a closed loop or other shape.

If it is determined, in step 910, that betting the betting progress indicator is "closed", the process 900 continues to step 912, in which a resolution of the betting round (or hand) is determined. In some embodiments, step 912 may not be performed as part of the process 900 and/or by the same device as is performing other steps of process 900. For example, the resolution of the betting round (or hand) may be performed via a primary game program for conducting the card game (e.g., primary game program 310*a* of FIG. 3). Accordingly, in some embodiments if it is determined in step 910 that betting for the current round has closed and/or that the betting progress indicator is closed (which may be distinct determinations in some embodiments), the process 900 may simply end or pause (e.g., until another hand or round in the hand is initiated, in which case the process 900 may begin again with step 904).

If, on the other hand, it is determined in step 910 that the betting progress indicator has not closed, the process 900 continues to step 914. In step 914 the betting decision of the next player (to whom the betting progress indicator had progressed in step 908) is determined. It is determined, in step 916, whether the betting decision comprises a decision which corresponds to a resetting of a betting progress indicator (e.g., was the betting decision to Raise the bet amount). In some embodiments, step 916 may comprise determining the bet amount of the player making the betting decision and comparing it to the previous bet amount for the hand. If the bet amount of the player is greater than the previous bet amount, the player may be determined to have Raised the bet. In other embodiments, the player may (e.g., in addition to selecting a particular bet amount) also actuate or select a betting decision type from an interface for playing the game (e.g., the player may actuate the "Raise" virtual button in area 420 of an interface such as the one in FIG. 4A). Thus, determining the betting decision may comprise determining a signal or input of the player as to what type of betting decision the player is making. In some embodiments, as described with respect to step 904, a database of possible betting decisions may be accessed and the appropriate action with respect to the betting progress indicator may be determined by matching the betting decision identified for the current player to a predetermined betting decision in the database and further identifying whether this betting decision corresponds to an advancement of the betting progress indicator in the database. In some embodiments, the betting progress indicator program (e.g., such as the betting progress indicator program 310 of FIG. 3) may comprise instructions for advancing the betting progress indicator to the next player position if the betting decision is of a first type (e.g., player Folds, Checks or Calls) and resetting the betting progress indicator if the betting decision is of a second type (e.g., the player Raises).

If it is determined, in step 914, that the betting decision is not an event which causes a resetting of the betting progress indicator (e.g., the betting decision is to Call or Fold), the process 900 returns to step 908 and the betting progress indicator is advanced or progresses to the next player position. If, on the other hand, it is determined in step 914 that the betting decision is one which causes the betting progress indicator to be reset, the process 900 proceeds to step 918 first, at which step the betting progress is reset at the current player position, to indicate a new betting cycle for the betting round or hand. As described herein, resetting a betting progress indicator may comprise restarting it anew from that player position (e.g., such that any progress or visual representation of the betting progress indicator prior to the current player position is deleted, removed or grayed out from the player interface). In other embodiments, resetting the betting progress indicator may comprise advancing it from the current player position in a different color, pattern, brightness, thickness or other visually discernable manner than had been used up to that point, to help players visually recognize when a new betting cycle for a current round or hand has been initiated (e.g., as illustrated in FIGS. 5A through 5F). In such embodiments, if it is determined in step 916 that the betting decision is not one which causes the betting progress indicator to be reset, the process 900 returning to step 908 may comprise advancing the betting progress indicator to the next player position in the same color, pattern, brightness, thickness, etc. Once step 918 is completed, the process 900 returns to step 908 and the steps 908-918 are repeated until betting for the round or hand closes (i.e., until the process 900 proceeds to step 912).

It should be noted that process 900 may proceed fairly quickly such that it does not slow down progress of the game. The steps of process 900 may be carried out simultaneously with other events in the game, such that the advancement (or resetting) of the betting progress indicator is integrated into the card game and proceeds in parallel with other indicators of progress in the game and information output to the players of the game.

Certain aspects, advantages, and novel features of the invention are described herein. It is to be understood that not necessarily all such advantages may be achieved in accordance with any particular embodiment of the invention. Thus, for example, those skilled in the art will recognize that the invention may be embodied or carried out in a manner that achieves one advantage or group of advantages as taught herein without necessarily achieving other advantages as may be taught or suggested herein.

Although several embodiments, examples and illustrations are disclosed below, it will be understood by those of ordinary skill in the art that the invention described herein extends beyond the specifically disclosed embodiments, examples and illustrations and includes other uses of the invention and obvious modifications and equivalents thereof. Embodiments of the invention(s) are described with reference to the accompanying figures, wherein like numerals refer to like elements throughout. The terminology used in the description presented herein is not intended to be interpreted in any limited or restrictive manner simply because it is being used in conjunction with a detailed description of certain specific embodiments of the invention (s). In addition, embodiments of the invention(s) can comprise several novel features and it is possible that no single feature is solely responsible for its desirable attributes or is essential to practicing the invention(s) herein described.

Rules of Interpretation

Numerous embodiments are described in this disclosure, and are presented for illustrative purposes only. The described embodiments are not, and are not intended to be, limiting in any sense. The presently disclosed invention(s) are widely applicable to numerous embodiments, as is readily apparent from the disclosure. One of ordinary skill in the art will recognize that the disclosed invention(s) may be practiced with various modifications and alterations, such as structural, logical, software, and electrical modifications. Although particular features of the disclosed invention(s) may be described with reference to one or more particular embodiments and/or drawings, it should be understood that such features are not limited to usage in the one or more particular embodiments or drawings with reference to which they are described, unless expressly specified otherwise.

The present disclosure is neither a literal description of all embodiments nor a listing of features of the invention that must be present in all embodiments.

The Title (set forth at the beginning of the first page of this disclosure) is not to be taken as limiting in any way as the scope of the disclosed invention(s).

The term "product" means any machine, manufacture and/or composition of matter as contemplated by 35 U.S.C. §101, unless expressly specified otherwise.

The terms "an embodiment", "embodiment", "embodiments", "the embodiment", "the embodiments", "one or more embodiments", "some embodiments", "one embodiment" and the like mean "one or more (but not all) disclosed embodiments", unless expressly specified otherwise.

The terms "the invention" and "the present invention" and the like mean "one or more embodiments of the present invention."

A reference to "another embodiment" in describing an embodiment does not imply that the referenced embodiment is mutually exclusive with another embodiment (e.g., an embodiment described before the referenced embodiment), unless expressly specified otherwise.

The terms "including", "comprising" and variations thereof mean "including but not limited to", unless expressly specified otherwise.

The terms "a", "an" and "the" mean "one or more", unless expressly specified otherwise.

The term "and/or", when such term is used to modify a list of things or possibilities (such as an enumerated list of possibilities) means that any combination of one or more of the things or possibilities is intended, such that while in some embodiments any single one of the things or possibilities may be sufficient in other embodiments two or more (or even each of) the things or possibilities in the list may be preferred, unless expressly specified otherwise. Thus for example, a list of "a, b and/or c" means that any of the following interpretations would be appropriate: (i) each of "a", "b" and "c"; (ii) "a" and "b"; (iii) "a" and "c"; (iv) "b" and "c"; (v) only "a"; (vi) only "b"; and (vii) only "c."

The term "plurality" means "two or more", unless expressly specified otherwise.

The term "herein" means "in the present disclosure, including anything which may be incorporated by reference", unless expressly specified otherwise.

The phrase "at least one of", when such phrase modifies a plurality of things (such as an enumerated list of things) means any combination of one or more of those things, unless expressly specified otherwise. For example, the phrase at least one of a widget, a car and a wheel means either (i) a widget, (ii) a car, (iii) a wheel, (iv) a widget and a car, (v) a widget and a wheel, (vi) a car and a wheel, or (vii) a widget, a car and a wheel.

The phrase "based on" does not mean "based only on", unless expressly specified otherwise. In other words, the phrase "based on" describes both "based only on" and "based at least on".

Each process (whether called a method, algorithm or otherwise) inherently includes one or more steps, and therefore all references to a "step" or "steps" of a process have an inherent antecedent basis in the mere recitation of the term 'process' or a like term. Accordingly, any reference in a claim to a 'step' or 'steps' of a process has sufficient antecedent basis.

When an ordinal number (such as "first", "second", "third" and so on) is used as an adjective before a term, that ordinal number is used (unless expressly specified otherwise) merely to indicate a particular feature, such as to distinguish that particular feature from another feature that is described by the same term or by a similar term. For example, a "first widget" may be so named merely to distinguish it from, e.g., a "second widget". Thus, the mere usage of the ordinal numbers "first" and "second" before the term "widget" does not indicate any other relationship between the two widgets, and likewise does not indicate any other characteristics of either or both widgets. For example, the mere usage of the ordinal numbers "first" and "second" before the term "widget" (1) does not indicate that either widget comes before or after any other in order or location; (2) does not indicate that either widget occurs or acts before or after any other in time; and (3) does not indicate that either widget ranks above or below any other, as in importance or quality. In addition, the mere usage of ordinal numbers does not define a numerical limit to the features identified with the ordinal numbers. For example, the mere usage of the ordinal numbers "first" and "second" before the term "widget" does not indicate that there must be no more than two widgets.

When a single device, component or article is described herein, more than one device, component or article (whether or not they cooperate) may alternatively be used in place of the single device, component or article that is described. Accordingly, the functionality that is described as being possessed by a device may alternatively be possessed by more than one device, component or article (whether or not they cooperate).

Similarly, where more than one device, component or article is described herein (whether or not they cooperate), a single device, component or article may alternatively be used in place of the more than one device, component or article that is described. For example, a plurality of computer-based devices may be substituted with a single computer-based device. Accordingly, the various functionality that is described as being possessed by more than one device, component or article may alternatively be possessed by a single device, component or article.

The functionality and/or the features of a single device that is described may be alternatively embodied by one or more other devices that are described but are not explicitly described as having such functionality and/or features. Thus, other embodiments need not include the described device itself, but rather can include the one or more other devices which would, in those other embodiments, have such functionality/features.

Devices that are in communication with each other need not be in continuous communication with each other, unless expressly specified otherwise. On the contrary, such devices need only transmit to each other as necessary or desirable, and may actually refrain from exchanging data most of the time. For example, a machine in communication with another machine via the Internet may not transmit data to the other machine for weeks at a time. In addition, devices that are in communication with each other may communicate directly or indirectly through one or more intermediaries.

A description of an embodiment with several components or features does not imply that all or even any of such components and/or features are required. On the contrary, a variety of optional components are described to illustrate the wide variety of possible embodiments of the present invention(s). Unless otherwise specified explicitly, no component and/or feature is essential or required.

Further, although process steps, algorithms or the like may be described in a sequential order, such processes may be configured to work in different orders. In other words, any sequence or order of steps that may be explicitly described does not necessarily indicate a requirement that the steps be performed in that order. The steps of processes described herein may be performed in any order practical. Further, some steps may be performed simultaneously despite being described or implied as occurring non-simultaneously (e.g., because one step is described after the other step). Moreover, the illustration of a process by its depiction in a drawing does not imply that the illustrated process is exclusive of other variations and modifications thereto, does not imply that the illustrated process or any of its steps are necessary to the invention, and does not imply that the illustrated process is preferred.

Although a process may be described as including a plurality of steps, that does not indicate that all or even any of the steps are essential or required. Various other embodiments within the scope of the described invention(s) include other processes that omit some or all of the described steps. Unless otherwise specified explicitly, no step is essential or required.

Although a product may be described as including a plurality of components, aspects, qualities, characteristics and/or features, that does not indicate that all of the plurality are essential or required. Various other embodiments within the scope of the described invention(s) include other products that omit some or all of the described plurality.

An enumerated list of items (which may or may not be numbered) does not imply that any or all of the items are mutually exclusive, unless expressly specified otherwise. Likewise, an enumerated list of items (which may or may not be numbered) does not imply that any or all of the items are comprehensive of any category, unless expressly specified otherwise. For example, the enumerated list "a computer, a laptop, a PDA" does not imply that any or all of the three items of that list are mutually exclusive and does not imply that any or all of the three items of that list are comprehensive of any category.

Headings of sections provided in this disclosure are for convenience only, and are not to be taken as limiting the disclosure in any way.

"Determining" something can be performed in a variety of manners and therefore the term "determining" (and like terms) includes calculating, computing, deriving, looking up (e.g., in a table, database or data structure), ascertaining, recognizing, and the like.

A "display" as that term is used herein is an area that conveys information to a viewer. The information may be dynamic, in which case, an LCD, LED, CRT, Digital Light Processing (DLP), rear projection, front projection, or the like may be used to form the display. The aspect ratio of the display may be 4:3, 16:9, or the like. Furthermore, the resolution of the display may be any appropriate resolution such as 480i, 480p, 720p, 1080i, 1080p or the like. The format of information sent to the display may be any appropriate format such as Standard Definition Television (SDTV), Enhanced Definition TV (EDTV), High Definition TV (HDTV), or the like. The information may likewise be static, in which case, painted glass may be used to form the display. Note that static information may be presented on a display capable of displaying dynamic information if desired. Some displays may be interactive and may include touch screen features or associated keypads as is well understood.

The present disclosure may refer to a "control system" or program. A control system or program, as that term is used herein, may be a computer processor coupled with an operating system, device drivers, and appropriate programs (collectively "software") with instructions to provide the functionality described for the control system. The software is stored in an associated memory device (sometimes referred to as a computer readable medium). While it is contemplated that an appropriately programmed general purpose computer or computing device may be used, it is also contemplated that hard-wired circuitry or custom hardware (e.g., an application specific integrated circuit (ASIC)) may be used in place of, or in combination with, software instructions for implementation of the processes of various embodiments. Thus, embodiments are not limited to any specific combination of hardware and software.

A "processor" means any one or more microprocessors, Central Processing Unit (CPU) devices, computing devices, microcontrollers, digital signal processors, or like devices. Exemplary processors are the INTEL PENTIUM or AMD ATHLON processors.

The term "computer-readable medium" refers to any statutory medium that participates in providing data (e.g., instructions) that may be read by a computer, a processor or a like device. Such a medium may take many forms, including but not limited to non-volatile media, volatile media, and specific statutory types of transmission media. Non-volatile media include, for example, optical or magnetic disks and other persistent memory. Volatile media include DRAM, which typically constitutes the main memory. Statutory types of transmission media include coaxial cables, copper wire and fiber optics, including the wires that comprise a system bus coupled to the processor. Common forms of computer-readable media include, for example, a floppy disk, a flexible disk, hard disk, magnetic tape, any other magnetic medium, a CD-ROM, Digital Video Disc (DVD), any other optical medium, punch cards, paper tape, any other physical medium with patterns of holes, a RAM, a PROM, an EPROM, a FLASH-EEPROM, a USB memory stick, a dongle, any other memory chip or cartridge, a carrier wave, or any other medium from which a computer can read. The terms "computer-readable memory" and/or "tangible media" specifically exclude signals, waves, and wave forms or other intangible or non-transitory media that may nevertheless be readable by a computer.

Various forms of computer readable media may be involved in carrying sequences of instructions to a processor. For example, sequences of instruction (i) may be delivered from RAM to a processor, (ii) may be carried over a wireless transmission medium, and/or (iii) may be formatted according to numerous formats, standards or protocols. For a more exhaustive list of protocols, the term "network" is defined below and includes many exemplary protocols that are also applicable here.

It will be readily apparent that the various methods and algorithms described herein may be implemented by a control system and/or the instructions of the software may be designed to carry out the processes of the present invention.

Where databases are described, it will be understood by one of ordinary skill in the art that (i) alternative database structures to those described may be readily employed, and (ii) other memory structures besides databases may be readily employed. Any illustrations or descriptions of any sample databases presented herein are illustrative arrangements for stored representations of information. Any number of other arrangements may be employed besides those suggested by, e.g., tables illustrated in drawings or elsewhere. Similarly, any illustrated entries of the databases represent exemplary information only; one of ordinary skill in the art will understand that the number and content of the entries can be different from those described herein. Further, despite any depiction of the databases as tables, other formats (including relational databases, object-based models, hierarchical electronic file structures, and/or distributed databases) could be used to store and manipulate the data types described herein. Likewise, object methods or behaviors of a database can be used to implement various processes, such as those described herein. In addition, the databases may, in a known manner, be stored locally or remotely from a device that accesses data in such a database. Furthermore, while unified databases may be contemplated, it is also possible that the databases may be distributed and/or duplicated amongst a variety of devices.

As used herein a "network" is an environment wherein one or more computing devices may communicate with one another. Such devices may communicate directly or indirectly, via a wired or wireless medium such as the Internet, LAN, WAN or Ethernet (or IEEE 802.3), Token Ring, or via any appropriate communications means or combination of communications means. Exemplary protocols include but are not limited to: Bluetooth™, Time Division Multiple Access (TDMA), Code Division Multiple Access (CDMA), Global System for Mobile communications (GSM), Enhanced Data rates for GSM Evolution (EDGE), General Packet Radio Service (GPRS), Wideband CDMA (WCDMA), Advanced Mobile Phone System (AMPS), Digital AMPS (D-AMPS), IEEE 802.11 (WI-FI), IEEE 802.3, SAP, the best of breed (BOB), system to system (S2S), or the like. Note that if video signals or large files are being sent over the network, a broadband network may be used to alleviate delays associated with the transfer of such large files, however, such is not strictly required. Each of the devices is adapted to communicate on such a communication means. Any number and type of machines may be in communication via the network. Where the network is the Internet, communications over the Internet may be through a website maintained by a computer on a remote server or over an online data network including commercial online service providers, bulletin board systems, and the like. In yet other embodiments, the devices may communicate with one another over RF, cable TV, satellite links, and the like. Where appropriate encryption or other security measures such as logins and passwords may be provided to protect proprietary or confidential information.

Communication among computers and devices may be encrypted to insure privacy and prevent fraud in any of a variety of ways well known in the art. Appropriate cryptographic protocols for bolstering system security are described in Schneier, APPLIED CRYPTOGRAPHY, PROTOCOLS, ALGORITHMS, AND SOURCE CODE IN C, John Wiley & Sons, Inc. 2d ed., 1996, which is incorporated by reference in its entirety.

The term "whereby" is used herein only to precede a clause or other set of words that express only the intended result, objective or consequence of something that is previously and explicitly recited. Thus, when the term "whereby" is used in a claim, the clause or other words that the term "whereby" modifies do not establish specific further limitations of the claim or otherwise restricts the meaning or scope of the claim.

It will be readily apparent that the various methods and algorithms described herein may be implemented by, e.g., appropriately programmed general purpose computers and computing devices. Typically a processor (e.g., one or more microprocessors) will receive instructions from a memory or like device, and execute those instructions, thereby performing one or more processes defined by those instructions. Further, programs that implement such methods and algorithms may be stored and transmitted using a variety of media (e.g., computer readable media) in a number of manners. In some embodiments, hard-wired circuitry or custom hardware may be used in place of, or in combination with, software instructions for implementation of the processes of various embodiments. Thus, embodiments are not limited to any specific combination of hardware and software. Accordingly, a description of a process likewise describes at least one apparatus for performing the process, and likewise describes at least one computer-readable medium and/or memory for performing the process. The apparatus that performs the process can include components and devices (e.g., a processor, input and output devices) appropriate to perform the process. A computer-readable medium can store program elements appropriate to perform the method.

The present disclosure provides, to one of ordinary skill in the art, an enabling description of several embodiments and/or inventions. Some of these embodiments and/or inventions may not be claimed in the present application, but may nevertheless be claimed in one or more continuing applications that claim the benefit of priority of the present application. Applicants intend to file additional applications to pursue patents for subject matter that has been disclosed and enabled but not claimed in the present application.

What is claimed is:

1. A method for facilitating an electronic game played by a plurality of players, the method comprising:

outputting an interface which displays on a virtual representation of a table a respective player icon for each player position representing a player of a plurality of players participating in a hand of a card game, the plurality of players including at least a first player, second player and a third player, thereby outputting a plurality of virtual player positions representing players participating in an online card game;

determining, by a processor of a computing device operable to facilitate output of information for the card game, a betting decision of the first player;

recognizing that the betting decision corresponds to a start of a betting progress indicator for the round of the card game, wherein the betting progress indicator comprises a bar that progresses from player position to player position along the virtual table during a betting cycle, which bar is re-set each time a new betting cycle is triggered and wherein a completion of a current betting cycle is visually represented by the bar completing a closed shape traced along the plurality of virtual player positions;

starting the betting progress indicator at a player position of the first player;

causing the betting progress indicator to progress to a player position of the second player;

determining a betting decision of the second player; and determining whether the betting decision of the second player re-opens betting for the round and causing one of the following in response to the betting decision:

(i) if the betting decision does not re-open betting for the round, causing the betting progress indicator to advance to a player position of the third player without being reset at the player position of the second player; and (ii) if the betting decision does re-open betting for the round, causing the betting progress indicator to be reset at the player position of second player before advancing the betting progress indicator to a player position of the third player.

2. The method of claim 1, further comprising:

determining whether betting for the round has closed by determining whether a player position for a current player due to make a betting decision for the hand is a player position of a player whose betting decision caused the betting progress indicator to be one of initiated and reset; and outputting an indication of a closing of the betting for the round when it is determined that betting for the round has closed.

3. The method of claim 1, wherein the card game is a Texas Hold'Em Poker game.

4. The method of claim 1, wherein causing the betting progress indicator to be reset comprises causing the betting progress indicator to be restarted, such that any indication of advancement of the betting progress indicator prior to the reset is removed from the interface.

5. The method of claim 1, wherein causing the betting progress indicator to be reset comprises causing the betting progress indicator to advance from the player position of the third player in a visually distinct manner from the manner in which it was advanced up to the player position of the third player.

6. A method for facilitating an electronic card game, the method comprising:

(i) determining, by a processor of a computing device operable to facilitate an electronic card game, that a betting event in a hand of the card game corresponds to initiation of a betting progress indicator, the betting decision having been made by a first player;

(ii) initiating, by the processor, the betting progress indicator at a position of the first player, wherein the betting progress indicator comprises a visual representation of a progress of betting in the hand and wherein the betting progress indicator comprises a bar that progresses from virtual player position to virtual player position along a virtual table of an online game during a betting cycle, which bar is re-set each time a new betting cycle is triggered and wherein a completion of a current betting cycle is visually represented by the bar completing a closed shape traced along all virtual player positions of the virtual table;

(iii) advancing the betting progress indicator to a position of a next player of the game, wherein the next player is a player who is next to make a betting decision in the hand;

(iv) determining whether the betting progress has advanced to a closed status and performing one of the following based on the determination:

(a) determining that betting for the hand has closed if it is determined that the betting progress indicator has advanced to a closed status; and (b) determining a betting decision of the next player if it is determined that the betting progress indicator has not advanced to a closed status, and further performing one of the following:

(1) if the betting decision of the second player is a first betting decision, returning to step (iii); and (2) if the betting decision of the second player is a second betting decision that is distinct from the first betting decision, resetting the betting progress indicator to indicate that a new betting cycle has been initiated for the hand and then returning to step (iii).

7. The method of claim 6, further comprising: outputting to the player an indication that betting for the hand has closed.

8. The method of claim 6, wherein the hand comprises one of a plurality of rounds playable during a single hand of the card game.

9. The method of claim 6, wherein the betting event in the hand of the card game which corresponds to initiation of a betting progress indicator comprises a betting event of a player in a predetermined position of the game.

10. The method of claim 9, wherein the game comprises a Texas Hold'Em poker game and the predetermined position comprises a Big Blind position.

11. The method of claim 6, wherein the second betting decision comprises a decision to raise a bet amount for the hand.

12. The method of claim 6, wherein the first betting decision comprises a decision to one of fold and call a current bet amount.

13. The method of claim 6, wherein resetting the betting progress indicator comprises causing the betting progress indicator to be restarted, such that any indication of advancement of the betting progress indicator prior to the reset is removed from the interface.

14. The method of claim 6, wherein resetting the betting progress indicator comprises causing the betting progress indicator to advance from the player position of the next player in a visually distinct manner from the manner in which it was advanced up to the player position of the next player.

15. The method of claim 6, wherein determining whether the betting progress has advanced to a closed status comprises determining whether a player position for the next player is a player position of a player whose betting decision caused the betting progress indicator to be one of initiated and reset.

16. A non-transitory computer readable medium storing instructions for a processor of a computing device, which instructions when read by the processor cause the processor to:

(i) determine that a betting event in a hand of a card game corresponds to initiation of a betting progress indicator, the betting decision having been made by a first player;

(ii) initiate the betting progress indicator at a position of the first player, wherein the betting progress indicator comprises a visual representation of a progress of betting in the hand and wherein the betting progress indicator comprises a bar that progresses from virtual player position to virtual player position along a virtual table of an online game during a betting cycle, which bar is re-set each time a new betting cycle is triggered and wherein a completion of a current betting cycle is visually represented by the bar completing a closed shape traced along all virtual player positions of the virtual table;

(iii) advance the betting progress indicator to a position of a next player of the game, wherein the next player is a player who is next to make a betting decision in the hand;

(iv) determine whether the betting progress has advanced to a closed status and performing one of the following based on the determination:

(a) close betting for the hand if it is determined that the betting progress indicator has advanced to a closed status; and (b) determine a betting decision of the next player if it is determined that the betting progress indicator has not advanced to a closed status, and further performing one of the following:

(1) if the betting decision of the second player is a first betting decision, returning to step (iii); and (2) if the betting decision of the second player is a second betting decision that is distinct from the first betting decision, resetting the betting progress indicator to indicate that a new betting cycle has been initiated for the hand and then returning to step (iii).

17. The non-transitory computer readable medium of claim 16, wherein the hand comprises one of a plurality of rounds playable during a single hand of the card game.

18. The non-transitory computer readable medium of claim 16, wherein the card game comprises an online poker game.

19. The non-transitory computer readable medium of claim 16, wherein the betting event in the hand of the card game which corresponds to initiation of a betting progress indicator comprises a betting event of a player in a predetermined position of the game.

20. The non-transitory computer readable medium of claim 19, wherein the game comprises a Texas Hold'Em poker game and the predetermined position comprises a Big Blind position.

21. The non-transitory computer readable medium of claim 16, wherein the second betting decision comprises a decision to raise a bet amount for the hand.

22. The non-transitory computer readable medium of claim 16, wherein the first betting decision comprises a decision to one of fold and call a current bet amount.

23. The non-transitory computer readable medium of claim 16, wherein resetting the betting progress indicator comprises causing the betting progress indicator to be restarted, such that any indication of advancement of the betting progress indicator prior to the reset is removed from the interface.

24. The non-transitory computer readable medium of claim 16, wherein resetting the betting progress indicator comprises causing the betting progress indicator to advance from the player position of the next player in a visually distinct manner from the manner in which it was advanced up to the player position of the next player.

25. The non-transitory computer readable medium of claim 16, wherein determining whether the betting progress has advanced to a closed status comprises determining whether a player position for the next player is a player position of a player whose betting decision caused the betting progress indicator to be one of initiated and reset.

* * * * *